US010847088B2

(12) United States Patent
Byun et al.

(10) Patent No.: US 10,847,088 B2
(45) Date of Patent: Nov. 24, 2020

(54) DISPLAY DEVICE AND DRIVING METHOD THEREOF

(71) Applicant: Samsung Display Co., Ltd., Yongin-si (KR)

(72) Inventors: Min Woo Byun, Yongin-si (KR); Seung Yeon Cho, Yongin-si (KR); Jae Du Noh, Yongin-si (KR); Min Kyu Woo, Yongin-si (KR); Jae Sic Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/835,170

(22) Filed: Dec. 7, 2017

(65) Prior Publication Data

US 2018/0158409 A1 Jun. 7, 2018

(30) Foreign Application Priority Data

Dec. 7, 2016 (KR) ..... 10-2016-0166077

(51) Int. Cl.
*G09G 3/3233* (2016.01)
*G09G 3/3266* (2016.01)
(Continued)

(52) U.S. Cl.
CPC ..... *G09G 3/3233* (2013.01); *G09G 3/3208* (2013.01); *G09G 3/3266* (2013.01);
(Continued)

(58) Field of Classification Search
CPC .. G09G 3/3233; G09G 3/3208; G09G 3/3266; G09G 3/3275; G09G 2310/0286;
(Continued)

(56) References Cited

U.S. PATENT DOCUMENTS 9,035,976 B2 5/2015 Lee et al.
9,183,781 B2 11/2015 Jang
(Continued)

FOREIGN PATENT DOCUMENTS

JP 2016-532900 A 10/2016
KR 10-2004-0024915 A 3/2004
(Continued)

OTHER PUBLICATIONS

EPO Extended Search Report dated Jun. 5, 2018, for corresponding European Patent Application No. 18151000.9 (10 pages).
(Continued)

*Primary Examiner* — Amy Onyekaba
(74) *Attorney, Agent, or Firm* — Lewis Roca Rothgerber Christie LLP

(57) ABSTRACT

A display device includes: a pixel unit including first pixels in a first pixel region, second pixels in a second pixel region, and third pixels in a third pixel region; a first scan driver configured to drive first scan lines coupled to the first pixels; a second scan driver configured to drive second scan lines coupled to the second pixels; and a third scan driver configured to drive third scan lines coupled to the third pixels, wherein the first scan driver, the second scan driver, and the third scan driver differently set a supply order of a scan signal supplied to the first scan lines, the second scan lines, and the third scan lines, corresponding to a first mode and a second mode different from the first mode.

28 Claims, 25 Drawing Sheets

(51) Int. Cl.
*G09G 3/3275* (2016.01)
*G09G 3/3208* (2016.01)

(52) U.S. Cl.
CPC ... *G09G 3/3275* (2013.01); *G09G 2300/0413* (2013.01); *G09G 2310/0205* (2013.01); *G09G 2310/0218* (2013.01); *G09G 2310/0283* (2013.01); *G09G 2310/0286* (2013.01); *G09G 2310/08* (2013.01)

(58) Field of Classification Search
CPC ... G09G 2310/0283; G09G 2310/0218; G09G 2310/0205; G09G 2310/08; G09G 2300/0413
See application file for complete search history.

(56) References Cited

U.S. PATENT DOCUMENTS 9,286,831 B2 3/2016 Qing et al.
2004/0189583 A1* 9/2004 Park ..... G09G 3/3677 345/100
2005/0024301 A1 2/2005 Funston
2005/0078076 A1 4/2005 Kim et al.
2005/0270873 A1 12/2005 Lee et al.
2006/0017666 A1 1/2006 Kim et al.
2006/0139294 A1 6/2006 Tanaka et al.
2006/0256066 A1 11/2006 Moon
2006/0267623 A1 11/2006 Yoo
2007/0040792 A1* 2/2007 Kwag ..... G09G 3/3666 345/100
2007/0159441 A1 7/2007 Yang et al.
2010/0020059 A1 1/2010 Suh
2010/0073335 A1 3/2010 Min et al.
2010/0079356 A1 4/2010 Hoellwarth
2010/0085335 A1 4/2010 Kato
2010/0097366 A1 4/2010 Kitayama et al.
2010/0188375 A1* 7/2010 Lee ..... G09G 3/3266 345/204
2011/0227889 A1* 9/2011 Choi ..... G09G 3/3233 345/209
2013/0293597 A1 11/2013 Mori et al.
2013/0335537 A1 12/2013 Goro et al.
2013/0335538 A1 12/2013 Shestak et al.
2014/0022289 A1 1/2014 Lee et al.
2014/0268356 A1 9/2014 Bolas et al.
2014/0368417 A1 12/2014 Yamazaki et al.
2015/0002558 A1* 1/2015 Kumeta ..... G09G 3/3291 345/690
2015/0109353 A1 4/2015 Yu et al.
2015/0137118 A1 5/2015 Umezaki et al.
2015/0154902 A1* 6/2015 Lee ..... G09G 3/20 345/213
2015/0154925 A1 6/2015 Koyama et al.
2015/0187262 A1 7/2015 Eom
2015/0187320 A1 7/2015 Ren
2015/0243238 A1 8/2015 Jung et al.
2015/0331482 A1 11/2015 Sawada et al.
2016/0005351 A1 1/2016 Jeon et al.
2016/0014402 A1 1/2016 Lee et al.
2016/0111053 A1 4/2016 Yamazaki et al.
2016/0117987 A1* 4/2016 Byun ..... G09G 3/3266 345/205
2016/0140921 A1 5/2016 Koyama et al.
2016/0190166 A1 6/2016 Kim et al.
2016/0299683 A1 10/2016 Kwon et al.
2016/0343315 A1 11/2016 Richards et al.
2016/0364198 A1* 12/2016 Song ..... G06F 3/1454
2017/0052635 A1 2/2017 Yu et al.
2017/0221411 A1 8/2017 Chang
2017/0357091 A1 12/2017 Jin
2018/0059420 A1* 3/2018 Woo ..... G02B 27/0172
2018/0075808 A1* 3/2018 Yamashita ..... G09G 3/3266
2018/0158409 A1 6/2018 Byun et al.
2018/0190202 A1 7/2018 Kong
2018/0197480 A1 7/2018 Choi et al.
2018/0197481 A1 7/2018 Choi et al.
2018/0197482 A1 7/2018 Choi et al.

FOREIGN PATENT DOCUMENTS

KR 10-2013-0000020 A 1/2013
KR 10-1341010 B1 12/2013
KR 10-2015-0078980 A 7/2015
KR 10-2016-0070445 A 6/2016
KR 10-2016-0120143 10/2016
KR 10-2018-0082692 7/2018
KR 10-2018-0082698 7/2018
KR 10-2018-0083237 7/2018

OTHER PUBLICATIONS

Office action issued in U.S. Appl. No. 15/856,807 by the USPTO, dated Sep. 26, 2019, 10 pages.
Office action issued in U.S. Appl. No. 15/864,914 by the USPTO, dated May 8, 2019, 32 pages.
Office action issued in U.S. Appl. No. 15/864,971 by the USPTO, dated Sep. 9, 2019, 20 pages.
Final Office action issued in U.S. Appl. No. 15/864,914 by the USPTO, dated Sep. 12, 2019, 37 pages.
Notice of Allowance issued in U.S. Appl. No. 15/856,807 by the USPTO, dated Jan. 8, 2020, 8 pages.
Notice of Allowance issued in U.S. Appl. No. 15/864,914 by the USPTO, dated Feb. 5, 2020, 12 pages.
U.S. Notice of Allowance dated Apr. 16, 2020, issued in U.S. Appl. No. 15/856,807 (9 pages).

* cited by examiner

DISPLAY DEVICE AND DRIVING METHOD THEREOF

CROSS-REFERENCE TO RELATED APPLICATION

This application claims priority to and the benefit of Korean Patent Application No. 10-2016-0166077, filed on Dec. 7, 2016, in the Korean Intellectual Property Office, the entire disclosure of which is incorporated by reference herein.

BACKGROUND

1. Field

Aspects of some example embodiments of the present invention relate to a display device and a driving method thereof.

2. Description of the Related Art

Recently, various types of electronic devices directly wearable on a body of a user have been developed. These devices are generally called wearable electronic devices.

As an example of the wearable electronic device, a head mounted display device (hereinafter, referred to as "HMD") displays a realistic image and hence provides high-degree of immersion. Accordingly, the HMD is used in various applications including movie appreciation.

The above information discussed in this Background section is only for enhancement of understanding of the background of the described technology and therefore it may contain information that does not constitute prior art that is already known to a person having ordinary skill in the art.

SUMMARY

Aspects of some example embodiments of the present invention include a display device that may be capable of improving display quality and a driving method of the display device.

According to some example embodiments of the present invention, a display device includes: a pixel unit including first pixels located in a first pixel region, second pixels located in a second pixel region, and third pixels located in a third pixel region; a first scan driver configured to drive first scan lines coupled to the first pixels; a second scan driver configured to drive second scan lines coupled to the second pixels; and a third scan driver configured to drive third scan lines coupled to the third pixels, wherein the first scan driver, the second scan driver, and the third scan driver differently set the supply order of a scan signal supplied to the first scan lines, the second scan lines, and the third scan lines, corresponding to a first mode and a second mode different from the first mode.

The display device may be set to the second mode when the display device is mounted in a wearable device, and be set to the first mode otherwise.

The display device may further include a timing controller configured to supply a first start signal to the first scan driver, supply a second start signal to the second scan driver, and supply a third start signal to the third scan driver.

When the display device is driven in the first mode, the first scan driver, the second scan driver, and the third scan driver may sequentially supply the scan signal to the first scan lines, the second scan lines, and the third scan lines.

When the display device is driven in the first mode, the timing controller may sequentially supply the first start signal, the second start signal, and the third start signal.

The first start signal, the second start signal, and the third start signal may be set to have the same width.

When the display device is driven in the second mode, the second scan driver may sequentially supply a scan signal to the second scan lines, and the first scan driver and the third scan driver may sequentially supply a scan signal to the first scan lines and the third scan lines at the same time.

The scan signal supplied to the first scan lines and the third scan lines may be set to have a width narrower than that of the scan signal supplied to the second scan lines.

When the display device is driven in the second mode, k (k is a natural number of 3 or more) scan signals may be supplied to each of the second scan lines, and I (I is a natural number smaller than k) scan signals may be supplied to each of the first scan lines and the third scan lines.

At least one scan signal supplied to the first scan lines and the third scan lines may be set to have a width narrower than that of the scan signal supplied to the second scan lines.

When the display device is driven in the second mode, the timing controller may supply the second start signal and then supply the first start signal and the third start signal at the same time.

The second start signal may be set to have a width wider than that of each of the first start signal and the third start signal.

The display device may further include: a first emission driver configured to supply an emission control signal to first emission control lines coupled to the first pixels; and a second emission driver configured to supply an emission control signal to second emission control lines coupled to the second pixels and third emission control lines coupled to the third pixels.

The display device may further include a timing controller configured to supply a first emission start signal to the first emission driver and supply a second emission start signal to the second emission driver.

When the display device is driven in the first mode, the first emission driver and the second emission driver may sequentially supply the emission control signal to the first emission control lines, the second emission control lines, and the third emission control lines.

When the display device is driven in the first mode, the timing controller may sequentially supply the first emission start signal and the second emission start signal.

When the display device is driven in the second mode, the second emission driver may sequentially supply an emission control signal to the second emission control lines and the third emission control lines, and the first emission driver may sequentially supply an emission control signal to the first emission control lines to overlap with the emission control signal supplied to the third emission control lines.

When the display device is driven in the second mode, the timing controller may sequentially supply the second emission start signal and the first emission start signal.

The first pixel region may be located adjacent to a first horizontal line of the second pixel region, and the third pixel region may be located adjacent to the last horizontal line of the second pixel region.

The display device may further include a data driver configured to supply a data signal to data lines coupled to the first pixels, the second pixels, and the third pixels.

When the display device is driven in the second mode, the data driver may supply data signals of the first horizontal line of the second pixel region to the last horizontal line of the first pixel region, and supply data signals of the last horizontal line of the second pixel region to a first horizontal line of the third pixel region.

The display device may further include a memory configured to store first data corresponding to the first horizontal line of the second pixel region and second data corresponding to the last horizontal line of the second pixel region.

When the display device is driven in the second mode, the data driver may supply the same data signal to the first pixel region and the third pixel region.

According to an aspect of the present disclosure, there is provided a method for driving a display device including a first pixel region, a second pixel region, and a third pixel region, which are disposed adjacent to each other and each includes at least two scan lines, the method including: when the display device is driven in a first mode, sequentially supplying a scan signal to the first pixel region, the second pixel region, and the third pixel region; and when the display device is driven in a second mode different from the first mode, supplying a scan signal to the second pixel region and then supplying a scan signal to the first pixel region and the third pixel region.

The display device may be set to the second mode when the display device is mounted in a wearable device, and be set to the first mode otherwise.

When the display device is driven in the second mode, a scan signal may be simultaneously supplied to the first pixel region and the third pixel region.

When the display device is driven in the second mode, data signals of a first horizontal line of the second pixel region may be supplied to the last horizontal line of the first pixel region, and data signals of the last horizontal line of the second pixel region may be supplied to a first horizontal line of the third pixel region.

When the display device is driven in the second mode, the same image may be displayed in the first pixel region and the third pixel region.

BRIEF DESCRIPTION OF THE DRAWINGS

Aspects of some example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1A:
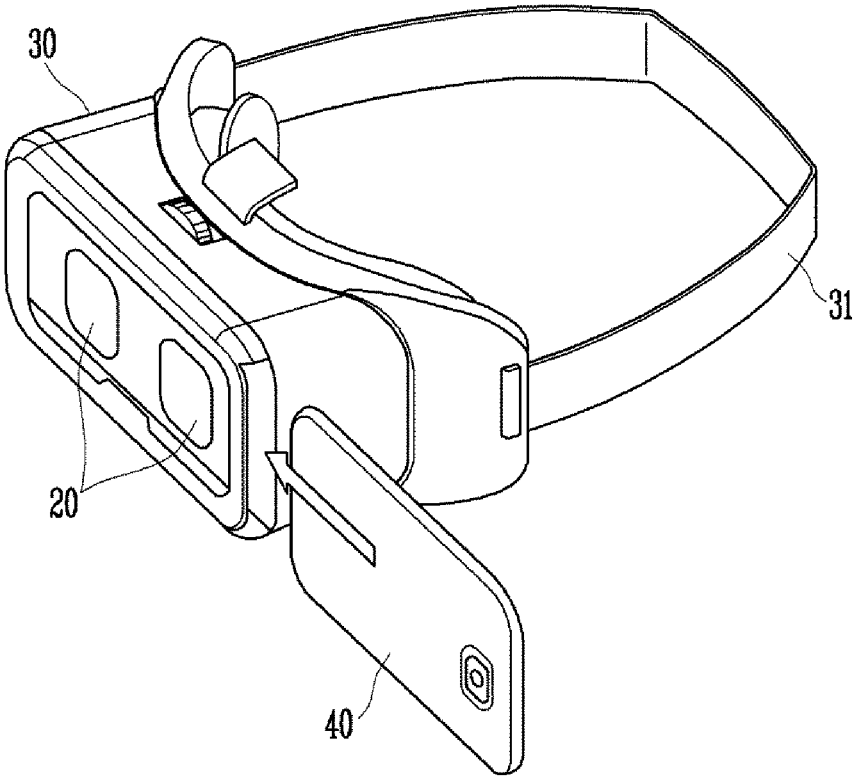
FIGS. 1A and 1B are perspective views of a wearable device according to some example embodiments of the present invention.

In the following detailed description, some example embodiments of the present invention have been shown and described. As those skilled in the art would realize, the described embodiments may be modified in various different ways, all without departing from the spirit or scope of the present disclosure. Accordingly, the drawings and description, are to be regarded as illustrative in nature and not restrictive.

In the entire specification, when an element is referred to as being "connected" or "coupled" to another element, it can be directly connected or coupled to the another element or be indirectly connected or coupled to the another element with one or more intervening elements interposed therebetween. Further, some of the elements that are not essential to the complete understanding of the disclosure are omitted for clarity. Also, like reference numerals refer to like elements throughout.

Figure 1B:
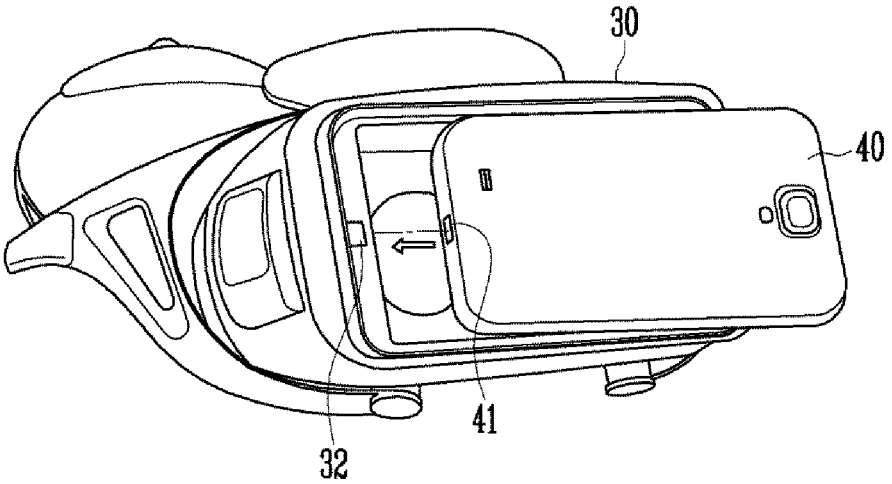

FIGS. 1A and 1B are views schematically illustrating a wearable device according to some example embodiments of the present invention. In FIGS. 1A and 1B, an HMD is illustrated as an embodiment of the wearable device. Referring to FIGS. 1A and 1B, the HMD according to the embodiment of the present disclosure includes a frame 30. A band 31 is provided to the frame 30. A user may wear the frame 30 on a head thereof by using the band 31. The frame 30 has a structure in which a display device 40 can be detachably mounted therein.

The display device 40 capable of being mounted in the HMD may be, for example, a smart phone. However, in the embodiment of the present disclosure, the display device 40 is not limited to the smart phone. For example, the display device 40 may be any one of electronic devices having display means such as a tablet PC, an electronic book reader, a personal digital assistant (PDA), a portable multimedia player (PMP), a camera, and the like.

When the display device 40 is mounted in the frame 30, a connection part 41 of the display device 40 is electrically coupled to a connection part 32 of the frame 30, and accordingly, communication between the frame 30 and the display device 40 can be performed. In order to control the display device 40, the HMD may include at least one of a touch panel, a button, and a wheel key, which are not shown in the drawing.

If the display device 40 is mounted in the HMD, the display device 40 may be driven in a second mode. If the display device 40 is separated from the HMD, the display device 40 may be driven in a first mode. If the display device 40 is mounted in the HMD, the driving mode of the display device 40 may be automatically changed to the second mode, or be changed to the second mode by a setting of the user.

In addition, when the display device 40 is detached from the HMD, the driving mode of the display device 40 may be automatically switched to the first mode, or the driving mode may be switched to the first mode by a user. The HMD includes lenses 20 corresponding to two eyes of the user. The lenses 20 may be set as fisheye lenses, wide-angle lenses, or the like so as to increase the field of view of the user.

If the display device 40 is fixed to the frame 30, the user views the display device 40 via the lenses 20, and accordingly, it is possible to provide an effect as if the user views images displayed on a large-sized screen located at a certain distance therefrom. Meanwhile, because the user views the display device 40 via the lenses 20, an effective display unit is divided into a region having a high visibility and a region having a low visibility. For example, based on both the eyes of the user, a central region has a high visibility, and the other region has a low visibility.

Therefore, a partial region of the display device 40 is blocked by the frame 30 such that the user can view more vivid images. For example, upper and lower regions of the display device 40 are blocked by the frame 30, and accordingly, portions of an image, which are displayed at the upper and lower regions, are not viewed by the user.

Figure 2:
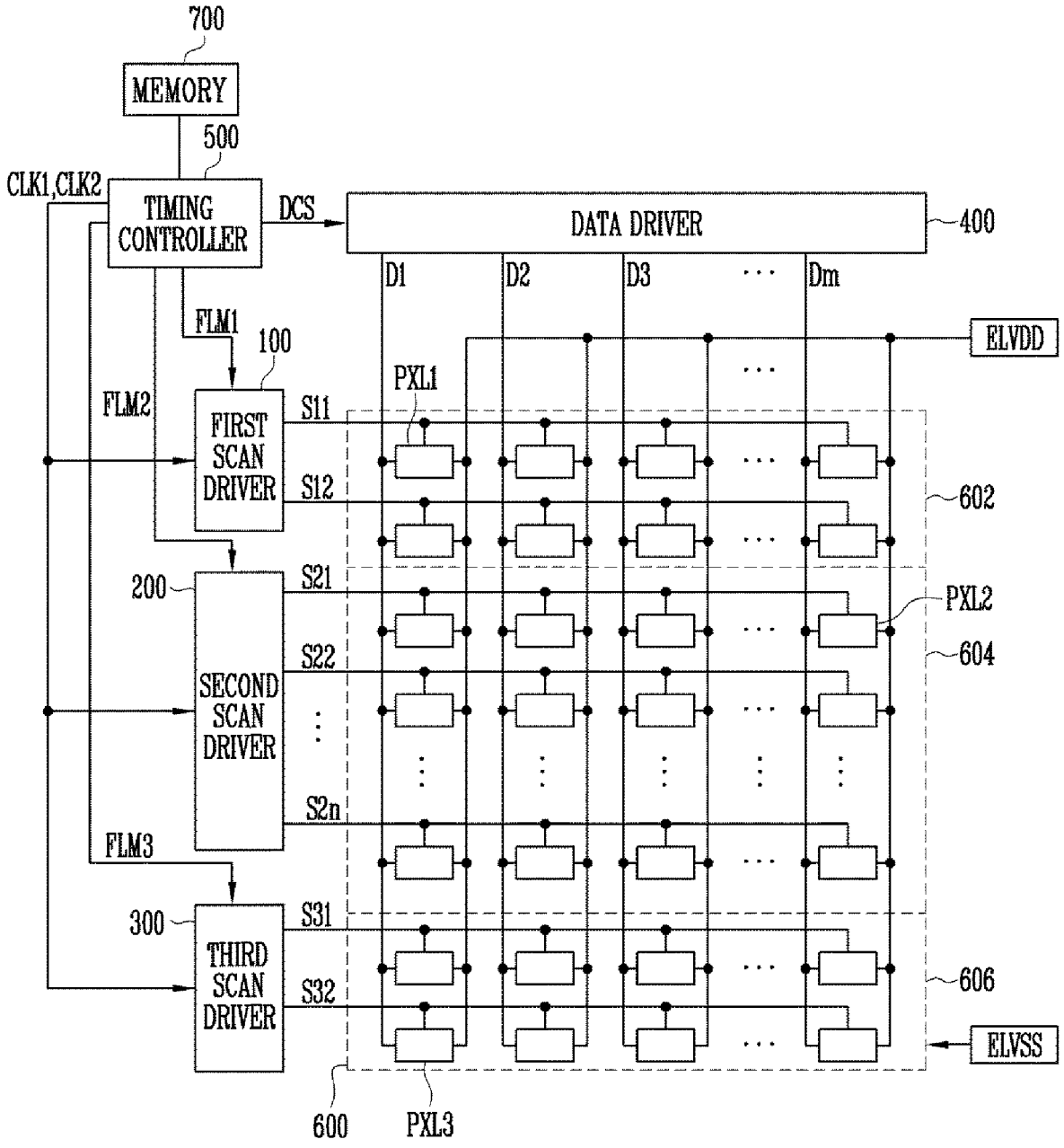
FIG. 2 is a schematic diagram of a display device according to some example embodiments of the present invention.

FIG. 2 is a view illustrating a display device according to some example embodiments of the present invention. Referring to FIG. 2, the display device according to some example embodiments of the present invention includes a first scan driver 100, a second scan driver 200, a third scan driver 300, a data driver 400, a timing controller 500, a pixel unit 600, and a memory 700.

The pixel unit 600 is divided into a first pixel region 602, a second pixel region 604, and a third pixel region 606. The first pixel region 602, the second pixel region 604, and the third pixel region 606 include pixels PXL1, PXL2, and PXL3, respectively, and accordingly, an image (e.g., a predetermined image) can be displayed. For example, the pixel unit 600 may be set as an effective display unit. The second pixel region 604 includes a central region of the pixel unit 600. The first pixel region 602 is located adjacent to a first horizontal line of the second pixel region 604, and the third pixel region 606 is located adjacent to the last horizontal line of the second pixel region 604.

Meanwhile, a case where widths of the first pixel region 602, the second pixel region 604, and the third pixel region 606 are equal to one another is illustrated in FIG. 2, but the present disclosure is not limited thereto. For example, the first pixel region 602 and/or the third pixel region 606 may have a shape of which width becomes narrower as becoming more distant from the second pixel region 604. In addition, the first pixel region 602 and/or the third pixel region 606 may be set to have a width narrower than that of the second pixel region 604.

Figure 3A:
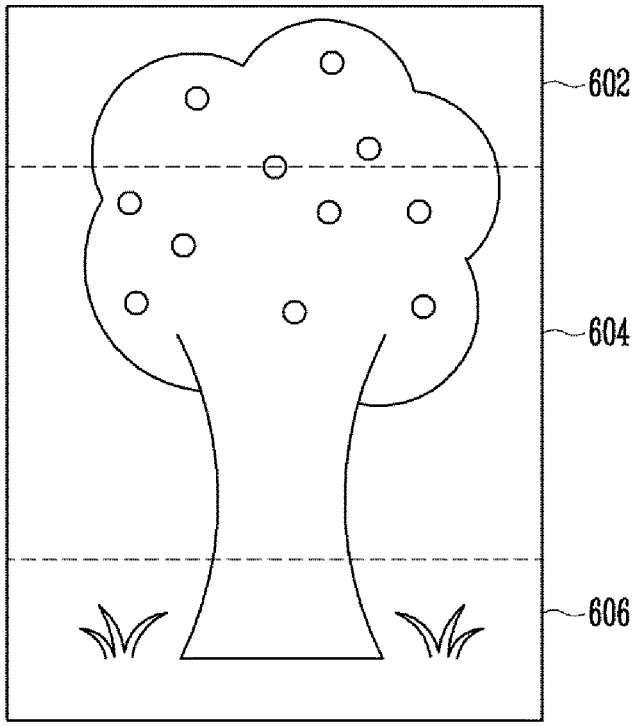
FIGS. 3A and 3B illustrate images displayed in a display device according to a first mode and a second mode, respectively, according to some example embodiments of the present invention.

When the display device is driven in the first mode (e.g., a normal mode), an image (e.g., a predetermined image), as shown in FIG. 3A, is displayed in the first pixel region 602, the second pixel region 604, and the third pixel region 606. At this time, a user views the image displayed in the first pixel region 602, the second pixel region 604, and the third pixel region 606.

Figure 3B:
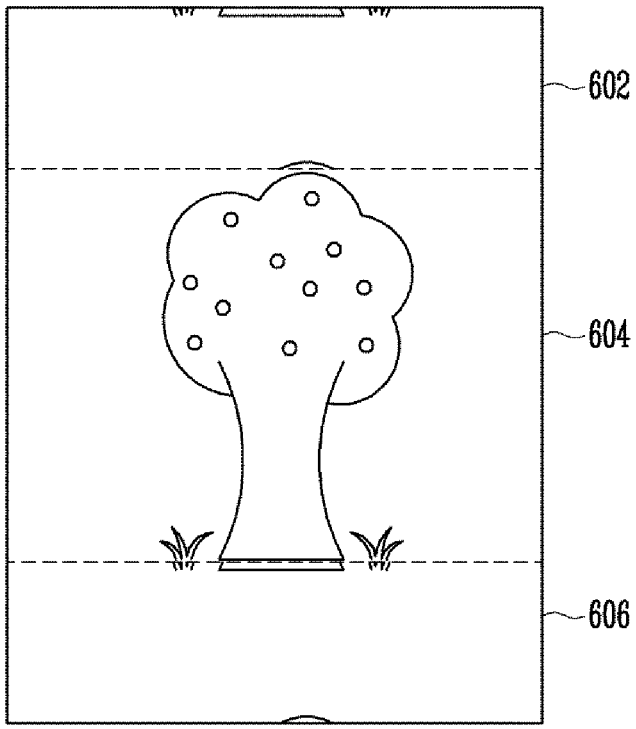

When the display device is driven in the second mode (e.g., a VR mode), an image (e.g., a predetermined image), as shown in FIG. 3B, is displayed in the first pixel region 602, the second pixel region 604, and the third pixel region 606. A portion of the image, which is displayed in the second pixel region 604, is viewed by the user.

Figure 3C:
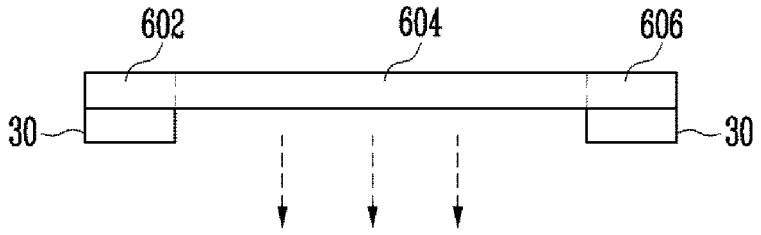
FIG. 3C is a view illustrating a pixel region blocked when the display device is driven in the second mode according to some example embodiments of the present invention.

When the display device is driven in the second mode, portions of the image, which are displayed in the first pixel region 602 and the third pixel region 606, are not viewed by the user. For example, the portions of the image, which are displayed in the first pixel region 602 and the third pixel region 606, may be blocked by the frame 30 as shown in FIG. 3C.

Therefore, when the display device is driven in the second mode, the first pixel region 602 and the third pixel region 606 display images (e.g., predetermined images) corresponding to dummy data. At this time, the same image is displayed in the first pixel region 602 and the third pixel region 606. That is, when the display device is driven in the second mode, the first pixel region 602 and the third pixel region 606 display the same image corresponding to the same data signal.

Here, a data signal supplied to the last horizontal line of the first pixel region 602 is set identical to that supplied to the first horizontal line of the second pixel region 604 such that the viewing of a boundary portion between the first pixel region 602 and the second pixel region 604 is minimized. In this case, a data signal identical to that supplied to the first horizontal line of the second pixel region 604 is also supplied to the last horizontal line of the third pixel region 606.

In addition, a data signal supplied to a first horizontal line of the third pixel region 606 is set identical to that supplied to the last horizontal line of the second pixel region 604 such that the viewing of a boundary portion between the second pixel region 604 and the third pixel region 606 is minimized. In this case, a data signal identical to that supplied to the last horizontal line of the second pixel region 604 is also supplied to a first horizontal line of the first pixel region 602.

Additionally, a dummy data signal is supplied to horizontal lines located between the first horizontal line and the last horizontal line of the first pixel region 602. Here, data signals having a gray level similar to that of the first horizontal line of the first pixel region 602 may be supplied to horizontal lines adjacent to the first horizontal line of the first pixel region 602. For example, dummy data signals may be supplied such that the gray level is gradually changed. Similarly, data signals having a gray level similar to that of the last horizontal line of the first pixel region 602 may be supplied to horizontal lines adjacent to the last horizontal line of the first pixel region 602. For example, dummy data signals may be supplied such that the gray level is gradually changed. Data signals identical to those supplied to the first pixel region 602 may also be supplied to the third pixel region 606.

For example, when a data signal corresponding to a gray level of 150 is supplied to the first horizontal line of the first pixel region 602, a data signal having a gray level of 149 or 151 may be supplied to a second horizontal line of the first pixel region 602. In addition, a data signal having a gray level of 148 or 152 may be supplied to a third horizontal line of the first pixel region 602, and a data signal having a gray level of 147 or 153 may be supplied to a fourth horizontal line of the first pixel region 602. That is, dummy data signals may be supplied to horizontal lines adjacent to the first horizontal line of the first pixel region 602 such that the gray level is gradually changed from the data signal supplied to the first horizontal line of the first pixel region 602.

Meanwhile, when the data signal corresponding to the gray level of 150 is supplied to the first horizontal line of the first pixel region 602, a data signal corresponding to the gray level of 150 may be supplied to a plurality of horizontal lines adjacent to the first horizontal line of the first pixel region 602. In addition, data signals may be supplied to horizontal lines adjacent to the plurality of horizontal lines such that the gray level is gradually increased or decreased from the gray level of 150.

Similarly, when the data signal corresponding to the gray level of 150 is supplied to the last horizontal line of the first pixel region 602, dummy data signals may be supplied to horizontal lines adjacent to the last horizontal line of the first pixel region 602 such that the gray level is gradually changed from the gray level of 150. In addition, when the data signal corresponding to the gray level of 150 is supplied to the last horizontal line of the first pixel region 602, the data signal corresponding to the gray level of 150 may be supplied to a plurality of horizontal lines adjacent to the last horizontal line of the first pixel region 602. In addition, data signals may be supplied to horizontal lines adjacent to the plurality of horizontal lines such that the gray level is gradually increased or decreased from the gray level of 150.

Meanwhile, there may be expected a method for allowing a scan signal not to be supplied to scan lines S11, S12, S31, and S32 coupled to first pixels PXL1 and third pixels PXL3 during a period in which the display device is driven in the second mode. That is, any separate data signal is not supplied to the first pixels PXL1 and the third pixels PXL3, and accordingly, a gate-off voltage may be supplied to the scan lines S11, S12, S31, and S32.

When any data signal is not supplied to the first pixels PXL1 and the third pixels PXL3, characteristics of driving transistors included in the first pixel PXL1 and the third pixel PXL3 are set different from those of a driving transistor included in a second pixel PXL2. That is, there occurs a difference in characteristic between the driving transistors included in the first pixel PXL1 and the third pixel PXL3 and the driving transistor included in the second pixel PXL2, and accordingly, the pixel regions 602, 604, and 606 may be viewed in the shape of blocks by the user when the display device is driven in the first mode. Thus, according to some example embodiments of the present invention, when the display device is driven in the second mode, an image (e.g., a predetermined image) is displayed in the first pixel region 602 and the third pixel region 606, and accordingly, it is possible to the prevent pixel regions 602, 604, and 606 from being viewed in the shape of blocks by the user when the display device is driven in the first mode.

First pixels PXL1 are formed in the first pixel region 602. The first pixels PXL1 are located to be coupled to first scan lines S11 and S12 and data lines D1 to Dm. When a first scan signal is supplied to the first scan lines S11 and S12, the first pixels PXL1 are selected to receive a data signal supplied from the data lines D1 to Dm. Each of the first pixels PXL1 receiving the data signal generates light of a predetermined luminance while controlling the amount of current flowing from a first power source ELVDD to a second power source ELVSS via an organic light emitting diode (not shown).

Second pixels PXL2 are formed in the second pixel region 604. The second pixels PXL2 are located to be coupled to second scan lines S21 to S2*n* and the data lines D1 to Dm. When a second scan signal is supplied to the second scan lines S21 to S2*n*, the second pixels PXL2 are selected to receive a data signal supplied from the data lines D1 to Dm. Each of the second pixels PXL2 receiving the data signal generates light of a predetermined luminance while controlling the amount of current flowing from the first power source ELVDD to the second power source ELVSS via an organic light emitting diode.

Third pixels PXL3 are formed in the third pixel region 606. The third pixels PXL3 are located to be coupled to third scan lines S31 and S32 and the data lines D1 to Dm. When a third scan signal is supplied to the third scan lines S31 and S32, the third pixels PXL3 are selected to receive a data signal supplied from the data lines D1 to Dm. Each of the third pixels PXL3 receiving the data signal generates light of a predetermined luminance while controlling the amount of current flowing from the first power source ELVDD to the second power source ELVSS via an organic light emitting diode.

Meanwhile, according to some example embodiments of the present invention, the first to third pixels PXL1 to PXL3 may be implemented as various types of circuits currently known in the art. For example, the first to third pixels PXL1 to PXL3 may be formed in various circuit structures each including a driving transistor.

Additionally, two first scan lines 511 and S12 and two third scan lines S31 and S32 are illustrated in FIG. 2, but the present disclosure is not limited thereto. The number of first scan lines S1 may be set to at least two by considering a region overlapping with the frame 30. For example, one hundred or more first scan lines S1 may be formed in the first pixel region 602. Similarly, the number of third scan lines S3 may be set to at least two by considering a region overlapping with the frame 30. For example, one hundred or more third scan lines S3 may be formed in the third pixel region 606.

The first scan driver 100 supplies the first scan signal to the first scan lines S11 and S12. If the first scan signal is supplied to the first scan lines S11 and S12, the first pixels PXL1 are sequentially selected in units of horizontal lines. To this end, the first scan signal is set to a gate-on voltage such that transistors included in the first pixels PXL1 can be turned on.

The second scan driver 200 supplies the second scan signal to the second scan lines S21 to S2*n*. If the second scan signal is supplied to the second scan lines S21 to S2*n*, the second pixels PXL2 are sequentially selected in units of horizontal lines. To this end, the second scan signal is set to a gate-on voltage such that transistors included in the second pixels PXL2 can be turned on.

The third scan driver 300 supplies the third scan signal to the third scan lines S31 and S32. If the third scan signal is supplied to the third scan lines S31 and S32, the third pixels PXL3 are sequentially selected in units of horizontal lines. To this end, the third scan signal is set to a gate-on voltage such that transistors included in the third pixels PXL3 can be turned on.

The data driver 400 receives a data control signal DCS supplied from the timing controller 500. The data driver 400 receiving the data control signal DCS supplies a data signal to the data lines D1 to Dm. When the display device is driven in the first mode, the first scan driver 100, the second scan driver 200, and the third scan driver 300 may sequentially supply the first scan signal, the second scan signal, and the third scan signal. Then, the data signal supplied from the data driver 400 is sequentially supplied to the first pixels PXL1, the second pixels PXL2, and the third pixels PXL3, and accordingly, the pixel unit 600 displays an image (e.g., a predetermined image).

When the display device is driven in the second mode, the second scan driver 200 may sequentially supply the second scan signal. Then, the data signal supplied from the data driver 400 is sequentially supplied to the second pixels PXL2, and accordingly, an image (e.g., a predetermined image) is displayed in the second pixel region 604.

In addition, when the display device is driven in the second mode, the first scan signal supplied from the first scan driver 100 and the third scan signal supplied from the third scan driver 300 are sequentially supplied at the same time after the second scan signal is supplied. In this case, the first scan signal supplied from the first scan driver 100 overlaps with the third scan signal supplied from the third scan driver 300.

For example, the first scan signal supplied to a first first scan line S11 may overlap with the third scan signal supplied to a first third scan line S31. In addition, the first scan signal supplied to the last first scan line S12 may overlap with the third scan signal supplied to the last third scan line S32. In this case, the same image is displayed in the first pixel region 602 and the third pixel region 606.

Additionally, when the first scan signal is supplied to the last first scan line S12, the data driver 400 supplies a data signal corresponding to the first horizontal line of the second pixel region 604. When the third scan signal is supplied to the first third scan line S31, the data driver 400 supplies a data signal corresponding to the last horizontal line of the second pixel region 604. Thus, boundary portions between the pixel regions 602, 604, and 606 can be prevented from be viewed by the user, and accordingly, the display quality of the display device can be improved.

The memory 700 stores first data corresponding to the first horizontal line of the second pixel region 604 and second data corresponding to the last horizontal line of the second pixel region 604. When the display device is driven in the second mode, the timing controller 500 supplies the first and second data stored in the memory 700 to the data driver 400.

The timing controller 500 generates clock signals CLK1 and CLK2, start signals FLM1, FLM2, and FLM3, and the data control signal DCS, based on timing signals supplied from the outside. The clock signals CLK1 and CLK2 generated by the timing controller 500 are supplied to the first scan driver 100, the second scan driver 200, and the third scan driver 300. In addition, a first start signal FLM1 generated by the timing controller 500 is supplied to the first scan driver 100, a second start signal FLM2 generated by the timing controller 500 is supplied to the second scan driver 200, and a third start signal FLM3 generated by the timing controller 500 is supplied to the third scan driver 300. In addition, the data control signal DCS generated by the timing controller 500 is supplied to the data driver 400.

The first start signal FLM1 controls a supply timing of first scan signals. The clock signals CLK1 and CLK2 are used to shift the first start signal FLM1. The second start signal FLM2 controls a supply timing of second scan signals. The clock signals CLK1 and CLK2 are used to shift the second start signal FLM2. The third start signal FLM3 controls a supply timing of third scan signals. The clock signals CLK1 and CLK2 are used to shift the third start signal FLM3.

The data control signal DCS includes a source start signal, a source output enable signal, a source sampling clock, and the like. The source start signal controls a data sampling start time of the data driver 400. The source sampling clock controls a sampling operation of the data driver 400 at a rising or falling edge. The source output enable signal controls an output timing of the data driver 400.

Figure 4:
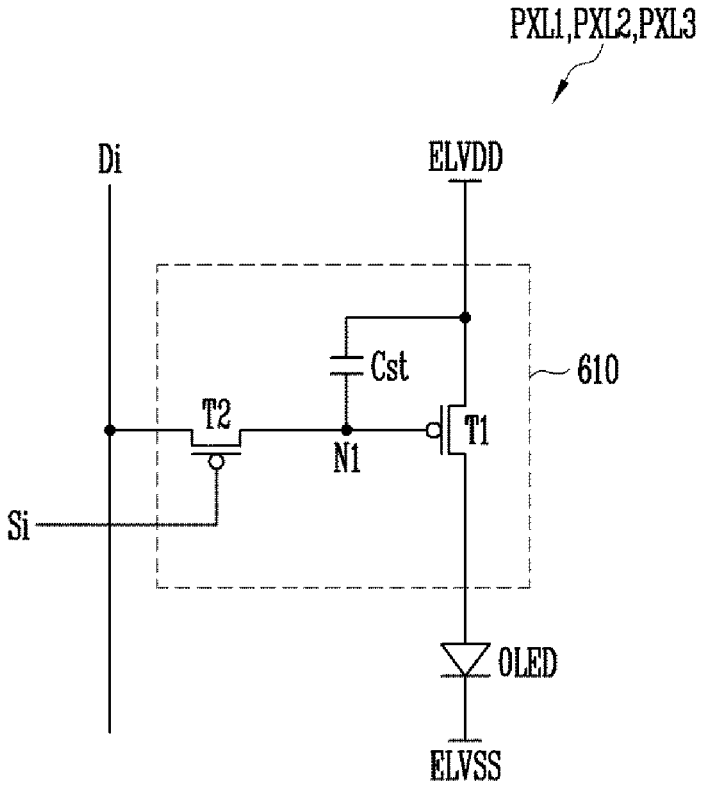
FIG. 4 is a view of the pixel shown in FIG. 2 according to some example embodiments of the present invention.

FIG. 4 is a view illustrating an embodiment of the pixel shown in FIG. 2. For convenience of description, a pixel PXL1, PXL2, or PXL3 coupled to an ith (i is a natural number) data line Di and an ith scan line Si(any one of the first scan lines S11 and S12, the second scan lines S21 to S2*n*, and the third scan lines S31 and S32) is illustrated in FIG. 4.

Referring to FIG. 4, the pixel PXL1, PXL2, or PXL3 according to the embodiment of the present disclosure includes an organic light emitting diode OLED and a pixel circuit 610 for controlling the amount of current supplied to the organic light emitting diode OLED. An anode electrode of the organic light emitting diode OLED is coupled to the pixel circuit 610, and a cathode electrode of the organic light emitting diode OLED is coupled to the second power source ELVSS. The organic light emitting diode OLED generates light of a predetermined luminance corresponding to the amount of current supplied from the pixel circuit 610.

The pixel circuit 610 controls the amount of current flowing from the first power source ELVDD to the second power source ELVSS via the organic light emitting diode OLED, corresponding to a data signal. To this end, pixel circuit 610 includes a first transistor T1, a second transistor T2, and a storage capacitor Cst.

The first transistor (driving transistor) T1 is coupled between the first power source ELVDD and the anode electrode of the organic light emitting diode OLED. In addition, a gate electrode of the first transistor T1 is coupled to a first node N1. The first transistor T1 controls the amount of the current flowing from the first power source ELVDD to the second power source ELVSS via the organic light emitting diode OLED, corresponding to a voltage of the first node N1.

The second transistor T2 is coupled between the data line Di and the first node N1. In addition, a gate electrode of the second transistor T2 is coupled to the scan line Si. The second transistor T2 is turned on when a scan signal is supplied to the scan line Si to allow the data line Di and the first node N1 to be electrically coupled to each other.

The storage capacitor Cst is coupled between the first power source ELVDD and the first node N1. The storage capacitor Cst stores a voltage corresponding to the data signal.

An operation process of the pixel will be described. First, a scan signal is supplied to the scan line Si such that the second transistor T2 is turned on. If the second transistor T2 is turned on, a data signal from the data line Di is supplied to the first node N1. At this time, the storage capacitor Cst stores a voltage corresponding to the data signal. After the voltage corresponding to the data signal is stored in the storage capacitor Cst, the second transistor T2 is turned off.

After that, the first transistor T1 controls the amount of current flowing from the first power source ELVDD to the second power source ELVSS via the organic light emitting diode OLED, corresponding to a voltage of the first node N1. Then, the organic light emitting diode OLED generates light of a predetermined luminance corresponding to the amount of the current.

The pixel PXL1, PXL2, or PXL3 display an image (e.g., a predetermined image) in the pixel unit 600 while repeating the above-described process. Additionally, in the embodiment of the present disclosure, the pixel structure of the pixel PXL1, PXL2, or PXL3 is not limited by FIG. 4. For example, the pixel PXL1, PXL2, or PXL3 may be implemented with various types of circuits currently known in the art.

Figure 5:
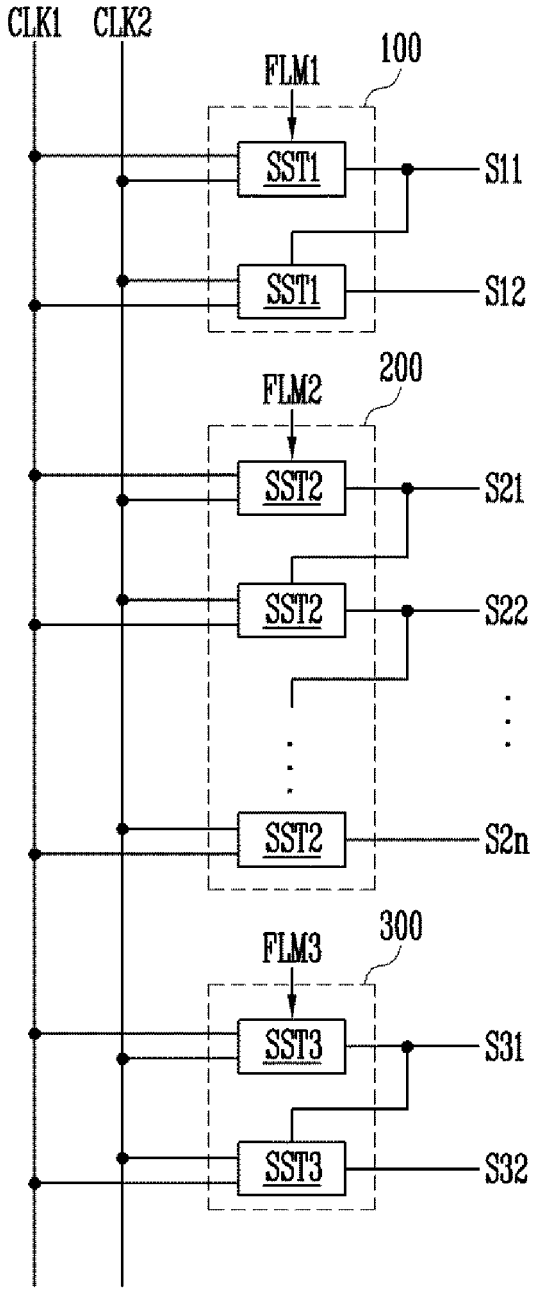
FIG. 5 is a view of the scan drivers shown in FIG. 2 according to some example embodiments of the present invention.

FIG. 5 is a view illustrating an embodiment of the scan drivers shown in FIG. 2. Referring to FIG. 5, the first scan driver 100 according to the embodiment of the present disclosure includes first scan stages SST1 respectively coupled to the first scan lines S11 and S12. The first scan stages SST1 are supplied with the clock signals CLK1 and CLK2, and supply a first scan signal to each of the first scan lines S11 and S12, corresponding to the first start signal FLM1. A first first scan stage SST1 supplies a first scan signal to the first first scan line S11, corresponding to the first start signal FLM1. A second first scan stage SST1 supplies a first scan signal to the second first scan line S12, corresponding to an output signal (e.g., a first scan signal) of the first first scan stage SST1.

Here, the number of first scan signals supplied to each of the first scan lines S11 and S12 is determined corresponding to a width of the first start signal FLM1. In other words, a larger number of first scan signals are supplied to each of the first scan lines S11 and S12 as the width of the first start signal FLM1 becomes wider. The width of the first start signal FLM1 may be variously set corresponding to driving methods.

Second scan stages SST2 are supplied with the clock signals CLK1 and CLK2, and supply a second scan signal to each of the second scan lines S21 to S2*n*, corresponding to the second start signal FLM2. A first second scan stage SST2 supplies a second scan signal to a first second scan line S21, corresponding to the second start signal FLM2. Each of the other second scan stages SST2 supplies a second scan signal to a second scan line (any one of S22 to S2*n*) coupled thereto, corresponding to an output signal of a previous stage (e.g., a second scan signal of the previous stage).

Here, the number of second scan signals supplied to each of the second scan lines S21 to S2*n* is determined corresponding to a width of the second start signal FLM2. In other words, a larger number of second scan signals are supplied to each of the second scan lines S21 to S2*n* as the width of the second start signal FLM2 becomes wider. The second start signal FLM2 may be variously set corresponding to driving methods.

Third scan stages SST3 are supplied with the clock signals CLK1 and CLK2, and supply a third scan signal to each of the third scan lines S31 and S32, corresponding to the third start signal FLM3. A first third scan stage SST3 supplies a third scan signal to the first third scan line S31, corresponding to the third start signal FLM3. A second third scan stage SST3 supplies a third scan signal to the second third scan line S32, corresponding to an output signal (e.g., a third scan signal) of the first third scan stage SST3.

Here, the number of third scan signals supplied to each of the third scan lines S31 and S32 is determined corresponding to a width of the third start signal FLM3. In other words, a larger number of third scan signals are supplied to each of the third scan lines S31 and S32 as the width of the third start signal FLM3 becomes wider. The width of the third start signal FLM3 may be variously set corresponding to driving methods.

Meanwhile, in the embodiment of the present disclosure, the scan stages SST1, SST2, or SST3 controls the number of scan signals supplied to the scan line, corresponding to the width of the start signal FLM1, FLM2, or FLM3, and may be implemented with various types of circuits currently known in the art.

Figure 6A:
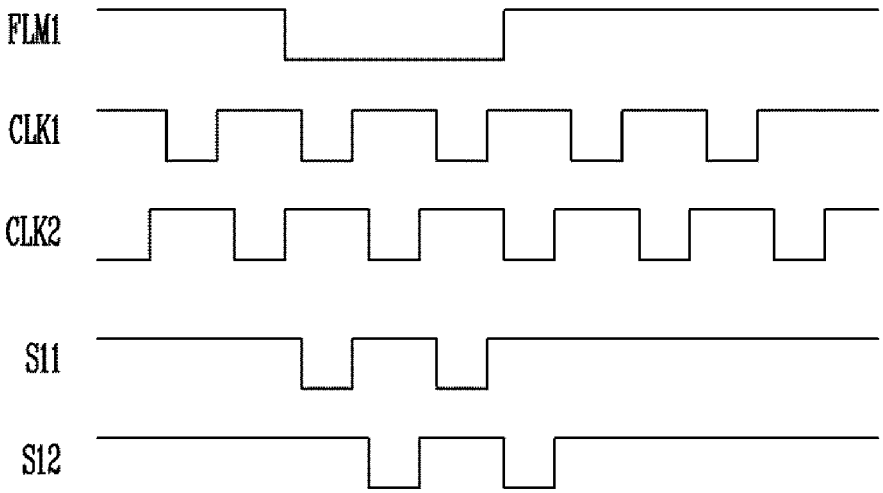
FIGS. 6A and 6B are waveform diagrams illustrating an operation process of first scan stages shown in FIG. 5.
Figure 6B:
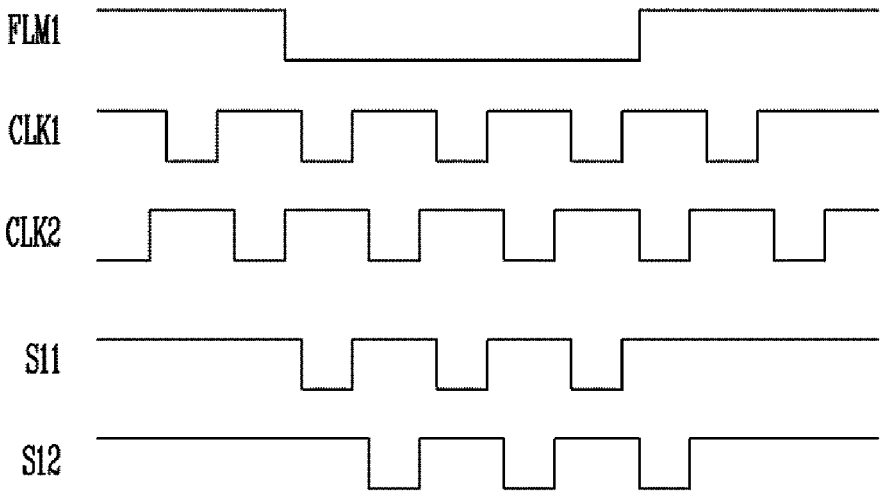

FIGS. 6A and 6B are views schematically illustrating an operation process of the first scan stages shown in FIG. 5. Referring to FIGS. 6A and 6B, the first start signal FLM1 having a width (e.g., a predetermined width) is supplied to the first first scan stage SST1. In this case, the first first scan stage SST1 may supply, as a first scan signal, first clock signals CLK1 overlapping with the first start signal FLM1 to the first first scan line S11.

For example, the first first scan stage SST1, as shown in FIG. 6A, may supply, as a first scan signal, two first clock signals CLK1 overlapping with the first start signal FLM1 to the first first scan line S11. In addition, the first first scan stage SST1, as shown in FIG. 6B, may supply, as a first scan signal, three first clock signals CLK1 overlapping with the first start signal FLM1 to the first first scan line S11.

The second first scan stage SST1 receives a first scan signal input from the first first scan stage SST1. In this case, the second first scan stage SST1 may supply, as a first scan signal, second clock signals CLK2 located adjacent to the received first scan signal to the second first scan line S12. Then, as shown in FIGS. 6A and 6B, the number of first scan signals output from the second first scan stage SST1 is set corresponding to the number of first scan signals output from the first first scan stage SST1. Meanwhile, the second scan stage SST2 and the third scan stage SST3 are also driven in the same manner as the first scan stage SST1, and therefore, their detailed descriptions will be omitted.

Figure 7:
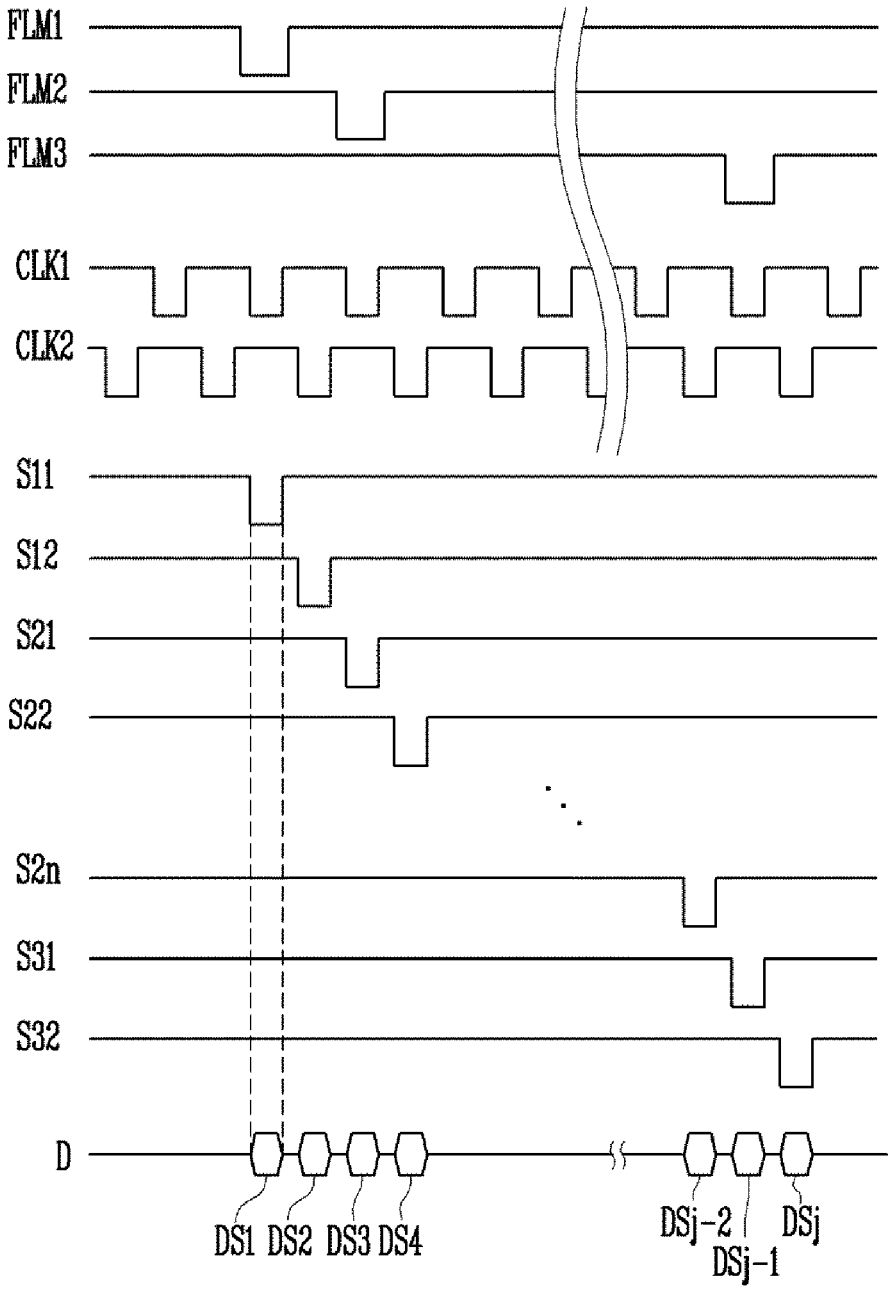
FIG. 7 is a waveform diagram illustrating a scan signal supplied to scan lines when the display device shown in FIG. 2 is driven in the first mode according to some example embodiments of the present invention.

FIG. 7 is a view illustrating an embodiment of a scan signal supplied to the scan lines when the display device shown in FIG. 2 is driven in the first mode. A case where one scan signal is supplied to the scan lines is illustrated in FIG. 7. Referring to FIG. 7, when the display device is driven in the first mode, the timing controller 500 sequentially supplies the first start signal FLM1, the second start signal FLM2, and the third start signal FLM3. Here, the supply timing of the first start signal FLM1, the second start signal FLM2, and the third start signal FLM3 is set such that first, second, and third scan signals are sequentially supplied to the first scan lines S11 and S12, the second scan lines S21 to S2*n*, and the third scan lines S31 and S32. In addition, the first start signal FLM1 and the third start signal FLM3 are set to have the same width.

If the first start signal FLM1 is supplied, the first scan signal is sequentially supplied to the first scan lines S11 and S12. Then, data signals DS1 and DS2 supplied from the data driver 400 are supplied to the first pixel region 602, and accordingly, an image (e.g., a predetermined image) corresponding to the data signals DS1 and DS2 is displayed in the first pixel region 602.

If the second start signal FLM2 is supplied, the second scan signal is sequentially supplied to the second scan lines S21 to S2*n*. Then, data signals DS3 to DSj-2 (j is a natural number) supplied from the data driver 400 are supplied to the second pixel region 604, and accordingly, an image (e.g., a predetermined image) corresponding to the data signals DS3 to DSj-2 is displayed in the second pixel region 604.

If the third start signal FLM3 is supplied, the third scan signal is sequentially supplied to the third scan lines S31 and S32. Then, data signals DSj-1 and DSj supplied from the data driver 400 are supplied to the third pixel region 606, and accordingly, an image (e.g., a predetermined image) corresponding to the data signals DSj-1 and DSj is displayed in the third pixel region 606.

Figure 9A:
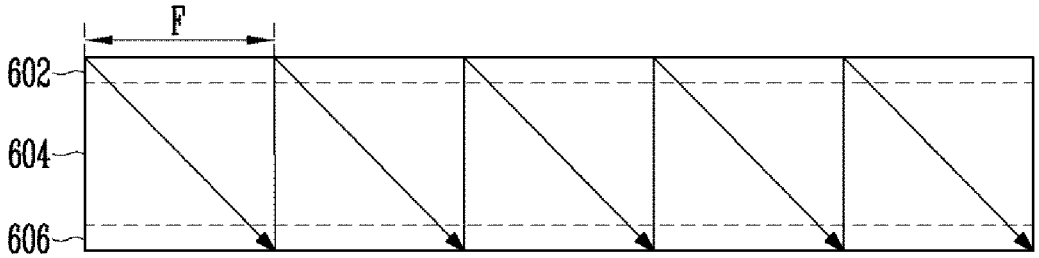
FIGS. 9A and 9B illustrate a supply sequence of signals corresponding to the first mode and the second mode according to some example embodiments of the present invention.

When the display device is driven in the first mode, the scan drivers 100, 200, and 300 sequentially supply scan signals to the scan lines S1, S2, and S3 while repeating the above-described process. That is, when the display device is driven in the first mode, as shown in FIG. 9A, scan signals are sequentially supplied to the first pixel region 602, the second pixel region 604, and the third pixel region 606 during a frame period F.

Figure 8A:
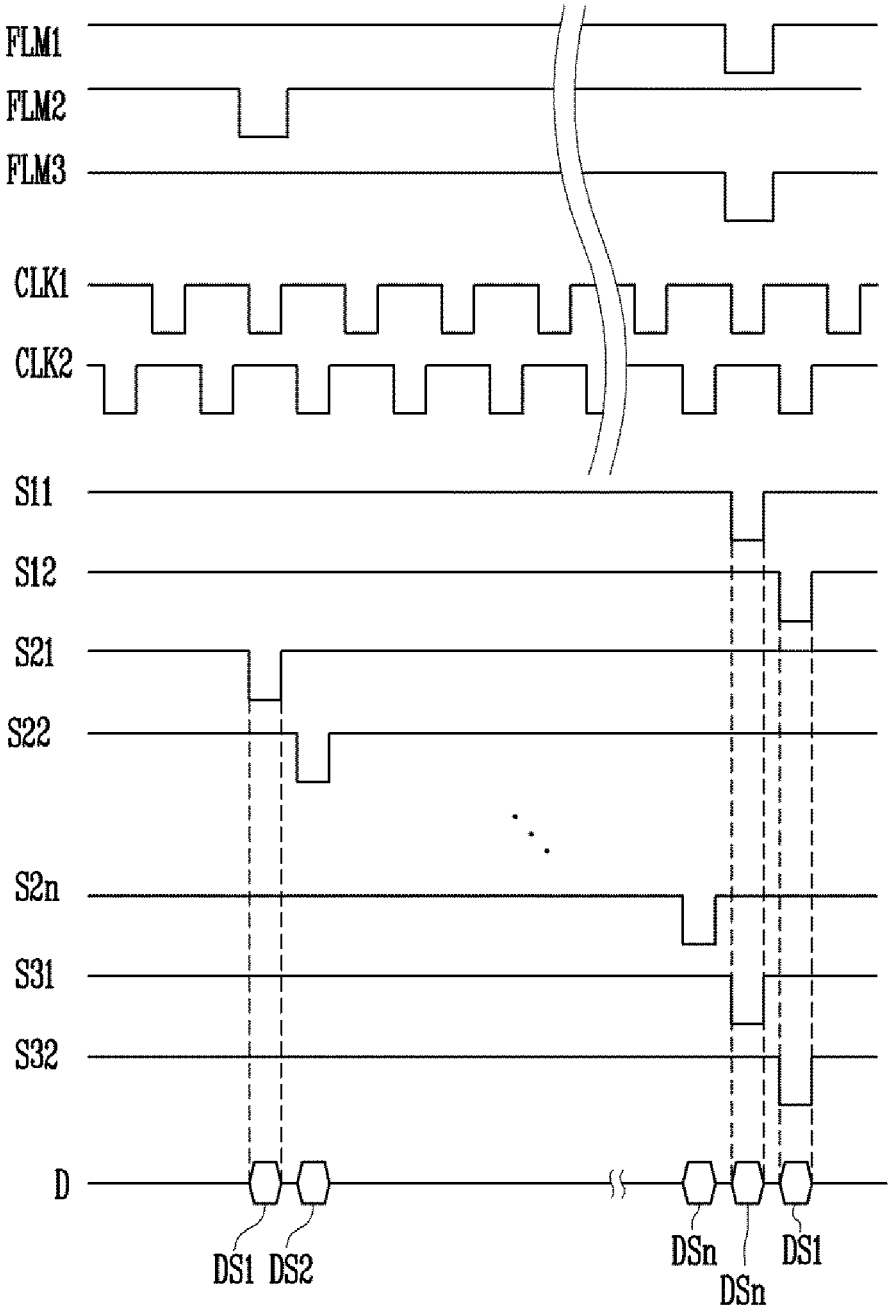
FIGS. 8A and 8B are waveform diagrams illustrating a scan signal supplied to the scan lines when the display device shown in FIG. 2 is driven in the second mode according to some example embodiments of the present invention.

FIG. 8A is a view illustrating an embodiment of a scan signal supplied to the scan lines when the display device shown in FIG. 2 is driven in the second mode. A case where one scan signal is supplied to the scan lines is illustrated in FIG. 8A. Referring to FIG. 8A, when the display device is driven in the second mode, the timing controller 500 supplies the second start signal FLM2 and then supplies the first start signal FLM1 and the third start signal FLM3 at the same time.

Here, the supply timing of the first start signal FLM1 and the third start signal FLM3 is set such that, after a second scan signal is supplied to the second scan lines S21 to S2*n*, a first scan signal and a third scan signal are supplied to the first scan lines S11 and S12 and the third scan lines S31 and S32, respectively. In addition, the first to third start signals FLM1 to FLM3 are set to have the same width.

If the second start signal FLM2 is supplied, the second scan signal is sequentially supplied to the second scan lines S21 to S2*n*. Then, data signals DS1 to DSn supplied from the data driver 400 are supplied to the second pixel region 604, and according, an image (e.g., a predetermined image) corresponding to the data signals DS1 to DSn is displayed in the second pixel region 604.

If the first start signal FLM1 and the third start signal FLM3 are simultaneously supplied, the first scan signal is sequentially supplied to the first scan lines S11 and S12, and the third scan signal is sequentially supplied to the third scan lines S31 and S32.

In this case, the first scan signal supplied to the first first scan line S11 overlaps with the third scan signal supplied to the first third scan line S31. Similarly, the first scan signal supplied to the last first scan line S12 overlaps with the third scan signal supplied to the last third scan line S32.

When the first scan signal and the third scan signal are supplied to the first first scan line S11 and the first third scan line S31, respectively, a data signal DSn corresponding to the last horizontal line of the second pixel region 604, which is supplied from the data driver 400, is supplied to the data lines D1 to Dm. Then, the second pixels PXL2 located on the last horizontal line of the second pixel region 604 and the third pixels PXL3 located on the first horizontal line of the third pixel region 606 display an image corresponding to the same data signal DSn. In this case, the boundary portion between the second pixel region 604 and the third pixel region 606 can be prevented from being viewed by the user.

When the first scan signal and the third scan signal are supplied to the last first scan line S12 and the last third scan line S32, respectively, a data signal DS1 corresponding to the first horizontal line of the second pixel region 604, which is supplied from the data driver 400, is supplied to the data lines D1 to Dm. Then, the second pixels PXL2 located on the first horizontal line of the second pixel region 604 and the first pixels PXL1 located on the last horizontal line of the first pixel region 602 display an image corresponding to the same data signal. In this case, the boundary portion between the first pixel region 602 and the second pixel region 604 can be prevented from being viewed by the user.

Additionally, three or more first scan lines S1 may be formed in the first pixel region 602, and three or more third scan lines S3 may be formed in the third pixel region 606. In this case, the data driver 400 may supply a dummy data signal (e.g., a predetermined dummy data signal), corresponding to the horizontal lines except the first horizontal line and the last horizontal line of each pixel region. The dummy data signal may be set to have various gray levels.

Figure 9B:
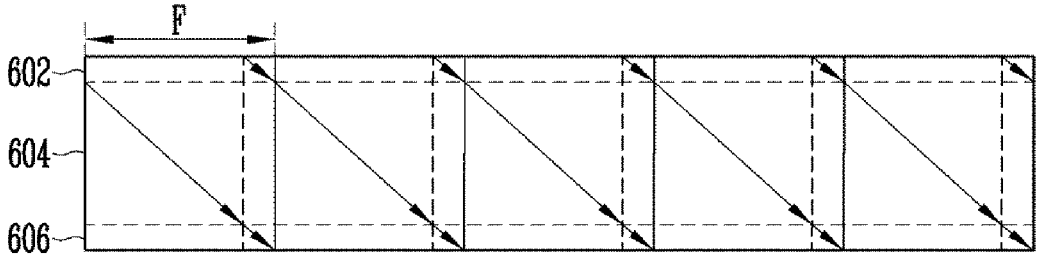

When the display device is driven in the second mode, the scan drivers 100, 200, and 300 supply scan signals to the scan lines S1, S2, and S3 while repeating the above-described process. That is, when the display device is driven in the second mode, as shown in FIG. 9B, a scan signal is sequentially supplied to the second pixel region 604, and then a scan signal is simultaneously supplied to the first pixel region 602 and the third pixel region 606.

Figure 10:
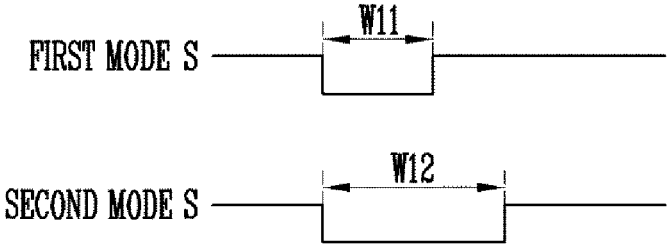
FIG. 10 illustrate widths of scan signals corresponding to the first mode and the second mode according to some example embodiments of the present invention.

Here, if the scan signal is simultaneously supplied to the first pixel region 602 and the third pixel region 606, one horizontal period, i.e., a period in which the scan signal is supplied can be additionally secured. In other words, as shown in FIG. 10, when the display device is driven in the first mode, the first scan signal, the second scan signal, and the third scan signal may be set to have an eleventh width W11. When the display device is driven in the second mode, the first scan signal, the second scan signal, and the third scan signal may be set to have a twelfth width W12 wider than the eleventh width W11. Then, when the display device is driven in the second mode, the stability of driving of the display device can be ensured, and simultaneously, the display quality of the display device can be improved.

In addition, when the display device is driven in the second mode, the first pixels PXL1 and the third pixels PXL3 display an image (e.g., a predetermined image). Then, when the display device is driven in the second mode, a difference in characteristic between the driving transistors respectively included in the first pixel PXL1, the second pixel PXL2, and the third pixel PXL3 is minimized. Accordingly, when the display device is driven in the first mode, the pixel regions 602, 604, and 606 can be prevent from being viewed in the shape of blocks by the user.

Figure 8B:
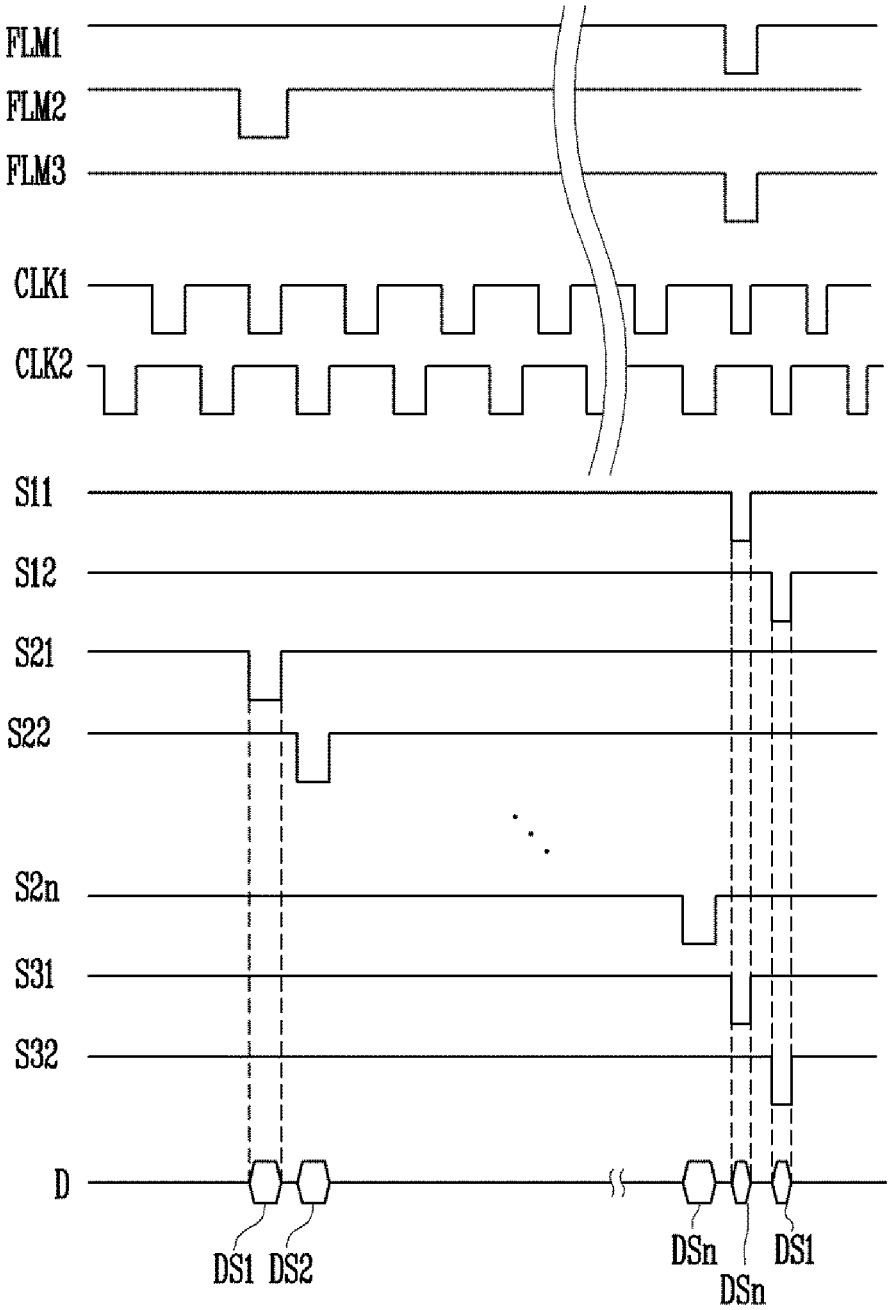

FIG. 8B is a view illustrating another embodiment of the scan signal supplied to the scan lines when the display device shown in FIG. 2 is driven in the second mode. In FIG. 8B, detailed descriptions of portions identical to those of FIG. 8A will be omitted. Referring to FIG. 8B, when the display device is driven in the second mode, the timing controller 500 supplies the second start signal FLM2 and then supplies the first start signal FLM1 and the third start signal FLM3 at the same time. Here, the first start signal FLM1 and the third start signal FLM3 are set to have a width narrower than that of the second start signal FLM2.

In addition, when the first start signal FLM1 and the third start signal FLM3 are simultaneously supplied, the first and second clock signals CLK1 and CLK2 are set to have widths narrower than those when the second start signal FLM2 is supplied. Then, the first scan signal supplied to the first scan lines S11 and S12, corresponding to the first start signal FLM1, and the third scan signal supplied to the third scan lines S31 and S32, corresponding to the third start signal FLM3, are set to have a width narrower than that of the second scan signal supplied to the second scan lines S21 to S2*n*.

If the first scan signal and the third scan signal are set to have a width narrower than that of the second scan signal, a time for supplying the second scan signal can be additionally secured. Then, the width of the second scan signal can be widened as compared with FIG. 8A. Accordingly, the stability of driving of the display device can be ensured, and simultaneously, the display quality of the display device can be improved.

Figure 11:
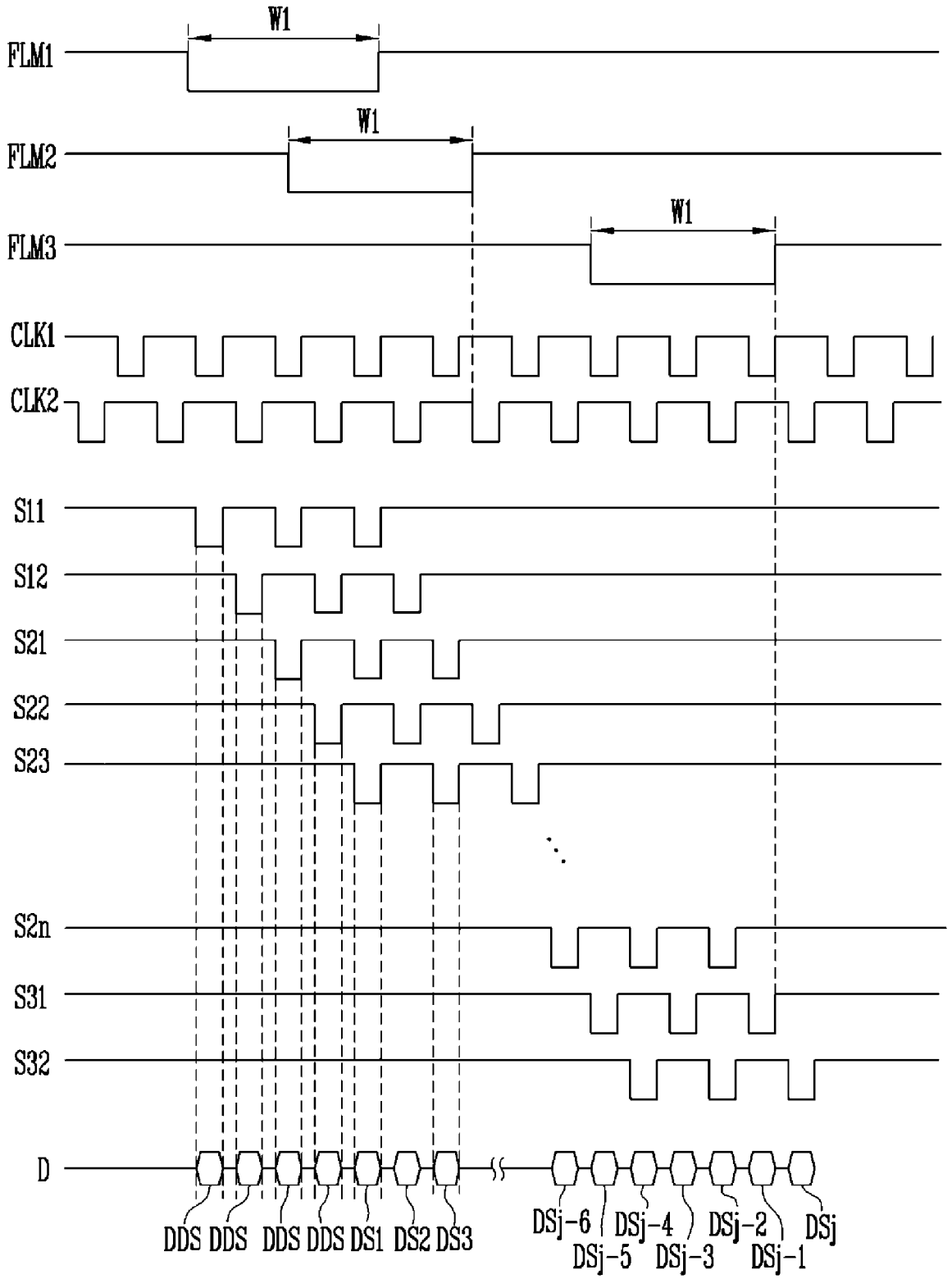
FIG. 11 is a waveform diagram illustrating the scan signal supplied to the scan lines when the display device shown in FIG. 2 is driven in the first mode according to some example embodiments of the present invention.

FIG. 11 is a view illustrating the scan signal supplied to the scan lines when the display device shown in FIG. 2 is driven in the first mode according to some example embodiments of the present invention. A case where a plurality of scan signals are supplied to each of the scan lines is illustrated in FIG. 11. Referring to FIG. 11, when the display device is driven in the first mode, the timing controller 500 sequentially supplies the first start signal FLM1, the second start signal FLM2, and the third start signal FLM3. Here, the supply timing of the first start signal FLM1, the second start signal FLM2, and the third start signal FLM3 is set such that first, second, and third scan signals are sequentially supplied to the first scan lines S11 and S12, the second scan lines S21 to S2*n*, and the third scan lines S31 and S32. In addition, the first to third start signals FLM1 to FLM3 may be set to have the same width, e.g., a first width W1.

If the first start signal FLM1 is supplied, a plurality of first scan signals are sequentially supplied to each of the first scan lines S11 and S12. In this case, the plurality of first scan signals, e.g., three first scan signals may be supplied to each of the first scan lines S11 and 512, corresponding to the width W1 of the first start signal FLM1. The data driver 400 supplies a data signal DS1 corresponding to the first horizontal line of the first pixel region 602 to the data lines D1 to Dm to be synchronized with the last first scan signal supplied to the first first scan line S11. After that, the data driver 400 sequentially supplies data signals DS2 to DSj corresponding to next horizontal lines to the data lines D1 to Dm.

Data signals DS1 and DS2 supplied from the data driver 400 are supplied to the first pixel region 602, corresponding to the sequentially supplied first scan signals, and accordingly, an image (e.g., a predetermined image) corresponding the data signals DS1 and DS2 is displayed in the first pixel region 602. Additionally, the data driver 400 supplies a dummy data signal DDS before the data signal DS1 corresponding to the first horizontal line of the first pixel region 602 is supplied. The dummy data signal DDS may be selected as any one of data signals to be supplied from the data driver 400.

If the second start signal FLM2 is supplied, a plurality of second scan signals are sequentially supplied to each of the second scan lines S21 to S2*n*. In this case, the plurality of second scan signals, e.g., three second scan signals may be supplied to each of the second scan lines S21 to S2*n*, corresponding to the width W1 of the second start signal FLM2. Then, data signals DS3 to DSj-2 supplied from the data driver 400 are supplied to the second pixel region 604, and accordingly, an image (e.g., a predetermined image) corresponding to the data signals DS3 to DSj-2 is displayed in the second pixel region 604.

If the third start signal FLM3 is supplied, a plurality of third scan signals are sequentially supplied to each of the third scan lines S31 and S32. Then, data signals DSj-1 and DSj are supplied in the third pixel region 606, and accordingly, an image (e.g., a predetermined image) corresponding to the data signals DSj-1 and DSj is displayed in the third pixel region 606.

When the display device is driven in the first mode, the scan drivers 100, 200, and 300 sequentially supply scan signals to the scan lines S1, S2, and S3 while repeating the above-described process. That is, when the display device is driven in the first mode, as shown in FIG. 9A, scan signals are sequentially supplied to the first pixel region 602, the second pixel region 604, and the third pixel region 606 during a frame period F.

Figure 12A:
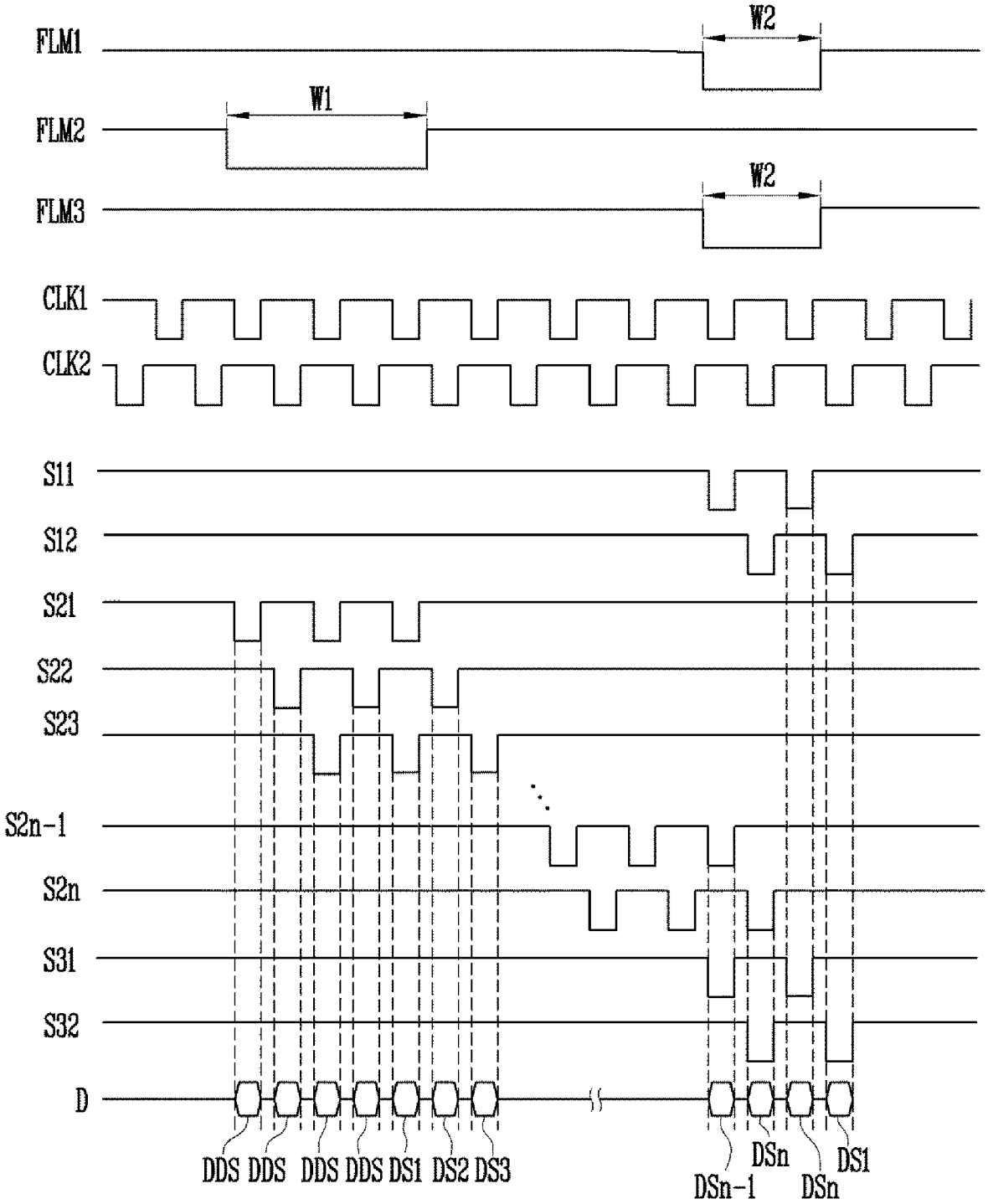
FIGS. 12A and 12B are waveform diagrams illustrating the scan signal supplied to the scan lines when the display device shown in FIG. 2 is driven in the second mode according to some example embodiments of the present invention.

FIG. 12A is a view illustrating another embodiment of the scan signal supplied to the scan lines when the display device shown in FIG. 2 is driven in the second mode. A case where a plurality of scan signals are supplied to the scan lines is illustrated in FIG. 12A. Referring to FIG. 12A, when the display device is driven in the second mode, the timing controller 500 supplies the second start signal FLM2 and then supplies the first start signal FLM1 and the third start signal FLM3 at the same time.

Here, the supply timing of the first start signal FLM1 and the third start signal FLM3 is set such that, after a second scan signal is supplied to the second scan lines S21 to S2*n*, a first scan signal and a third scan signal are simultaneously supplied to the first scan lines S11 and S12 and the third scan lines S31 and S32, respectively.

The second start signal FLM2 is set to have a first width W1, and the first start signal FLM1 and the third start signal FLM3 are set to have a second width W2 narrower than the first width W1. In other words, as compared with the second start signal FLM2, the width of the first start signal FLM1 and the third start signal FLM3 is set such that a smaller number of scan signals are supplied to the scan lines S1 and S3.

For example, the second start signal FLM2 may be set to have the first width W1 such that k (k is a natural number of 3 or more) second scan signals are supplied to each of the second scan lines S21 to S2*n*, and the first start signal FLM1 may be set to have the second width W2 such that I (I is a natural number smaller than k) first scan signals are supplied to each of the first scan lines S11 and S12. Similarly, the third start signal FLM3 may be set to have the same second width W2 as the first start signal FLM1 such that I third scan signals are supplied to each of the third scan lines S31 and S32.

If the second start signal FLM2 is supplied, a plurality of second scan signals, e.g., three second scan signals are sequentially supplied to each of the second scan lines S21 to S2*n*. The data driver 400 supplies a data signal DS1 corresponding to the first horizontal line of the second pixel region 604 to the data lines D1 to Dm to be synchronized with the last second scan signal (i.e., a third second scan signal) supplied to the first second scan line S21. After that, the data driver 400 sequentially supplies data signals DS2 to DSn to the data lines D1 to Dm, corresponding to the second pixel region 604. Additionally, the data driver 400 supplies a dummy data signal DDS before the data signal DS1 corresponding to the first horizontal line of the second pixel region 604 is supplied. The dummy data signal DDS may be selected as any one of data signals to be supplied from the data driver 400.

In detail, when first and second second scan signals are supplied to the first second scan line S21, second pixels PXL2 located on the first horizontal line of the second pixel region 604 are supplied with the dummy data signal DDS. In addition, when a third second scan signal is supplied to the first second scan line S21, the data signal DS1 corresponding to the first horizontal line of the second pixel region 604 is supplied. Then, the second pixels PXL2 located on the first horizontal line of the second pixel region 604 store the data signal DS1 corresponding to an image to be actually implemented.

Meanwhile, when the third second scan signal is supplied to the first second scan line S21, the second second scan signal is supplied to a third second scan line S23, and the first second scan signal is supplied to a fifth second scan line S25. Therefore, the data signal DS1 corresponding to the first horizontal line of the second pixel region 604 is supplied to second pixels PXL2 located on a third horizontal line of the second pixel region 604 and second pixels PXL2 located on a fifth horizontal line of the second pixel region 604. At this time, the second pixels PXL2 located on a third horizontal line of the second pixel region 604 and the second pixels PXL2 located on a fifth horizontal line of the second pixel region 604 are supplied with the data signal DS1 corresponding to the first horizontal line of the second pixel region 604 as the dummy data signal.

Meanwhile, the second pixel region 604 is a region viewed by the user, and a uniform image is to be displayed in the second pixel region 604. Therefore, a uniform load is to be set when a data signal DS is supplied. In other words, the second pixels PXL2 corresponding to three horizontal lines are to be selected when a data signal to be expressed is supplied to the second pixels PXL2.

The number of first scan signals supplied to each of the first scan lines S11 and S12 and the number of third scan signals supplied to each of the third scan lines S31 and S32 are set such that a uniform image can be displayed in the second pixel region 604. For example, when the last second scan signal is supplied to an (n−1)th second scan line S2*n*-1, a first first scan signal is supplied to the first first scan line S11, and a first third scan signal is supplied to the first third scan line S31. In this case, second pixels PXL2 coupled to the (n−1)th second scan line S2*n*-1 may store a voltage of a desired data signal DSn-1.

In addition, when the last second scan signal is supplied to an nth second scan line S2*n*, the first first scan signal is supplied to the second first scan line S12, and the first third scan signal is supplied to the second third scan line S32. In this case, second pixels PXL2 coupled to the nth second scan line S2*n* may store a voltage of a desired data signal DSn-1.

Meanwhile, the first pixel region 602 and the third pixel region 606 are regions not viewed by the user, and a displayed image may not be uniform. Therefore, i first scan signal and i third scan signal are supplied to the first scan lines 811 and S12 and the third scan line S31 and S32, respectively. The first start signal FLM1 and the third start signal FLM3 are simultaneously supplied. If the first start signal FLM1 and the third start signal FLM3 are simultaneously supplied, i first scan signal is sequentially supplied to each of the first scan lines S11 and S12, and i third scan signal is sequentially supplied to each of the third scan lines S31 and S32. For example, two first scan signals may be supplied to each of the first scan lines S11 and S12, and two third scan signals may be supplied to each of the third scan lines S31 and S32.

If the first start signal FLM1 and the third start signal FLM3 are simultaneously supplied, the first scan signal supplied to the first first scan line 811 overlaps with the third scan signal supplied to the first third scan line S31. Similarly, the first scan signal supplied to the last first scan line S12 overlaps with the third scan signal supplied to the last third scan line S32.

When a second first scan signal is supplied to the first first scan line S11 and a second third scan signal is supplied to the first third scan line S31, a data signal DSn corresponding to the last horizontal line of the second pixel region 604, which is supplied from the data driver 400, is supplied to the data lines D1 to Dm. Then, second pixels PXL2 located on the last horizontal line of the second pixel region 604 and third pixels PXL3 located on the first horizontal line of the third pixel 606 display an image corresponding to the same data signal DSn. In this case, the boundary portion between the second pixel region 604 and the third pixel region 606 can be prevented from being viewed by the user.

When the second first scan signal is supplied to the last first scan line S12 and the second third scan signal is supplied to the last third scan line S32, a data signal DS1 corresponding to the first horizontal line of the second pixel region 604, which is supplied from the data driver 400, is supplied to the data lines D1 to Dm. Then, second pixels PXL2 located on the first horizontal line of the second pixel region 604 and first pixels PXL1 located on the last horizontal line of the first pixel region 602 display an image corresponding to the same data signal DS1. In this case, the boundary portion between the first pixel region 602 and the second pixel region 604 can be prevented from being viewed by the user.

Additionally, three or more first scan lines S1 may be formed in the first pixel region 602, and three or more third scan lines S3 may be formed in the third pixel region 606. In this case, the data driver 400 may supply a dummy data signal (e.g., a predetermined dummy data signal), corresponding to the horizontal lines except the first horizontal line and the last horizontal line of each pixel region. The dummy data signal may be set to have various gray levels.

When the display device is driven in the second mode, the scan drivers 100, 200, and 300 supply scan signals to the scan lines S1, S2, and S3 while repeating the above-described process. That is, when the display device is driven in the second mode, as shown in FIG. 9B, a scan signal is sequentially supplied to the second pixel region 604, and then a scan signal is sequentially supplied to the first pixel region 602 and the third pixel region 606 at the same time.

Here, if a scan signal is simultaneously supplied to the first pixel region 602 and the third pixel region 606, one horizontal period, i.e., a period in which the scan signal is supplied can be additionally secured. In other words, as shown in FIG. 10, when the display device is driven in the first mode, the first scan signal, the second scan signal, and the third scan signal may be set to have an eleventh width W11. When the display device is driven in the second mode, the first scan signal, the second scan signal, and the third scan signal may be set to have a twelfth width W12 wider than the eleventh width W11. As described above, if the width of the scan signal when the display device is driven in the second mode is set wider than that when the display device is driven in the first mode, the stability of driving of the display device can be ensured, and simultaneously, the display quality of the display device can be improved.

In addition, when the display device is driven in the second mode, the first pixels PXL1 and the third pixels PXL3 display an image (e.g., a predetermined image). Then, when the display device is driven in the second mode, a difference in characteristic between the driving transistors respectively included in the first pixel PXL1, the second pixel PXL2, and the third pixel PXL3 is minimized. Accordingly, when the display device is driven in the first mode, the pixel regions 602, 604, and 606 can be prevent from being viewed in the shape of blocks by the user.

Figure 12B:
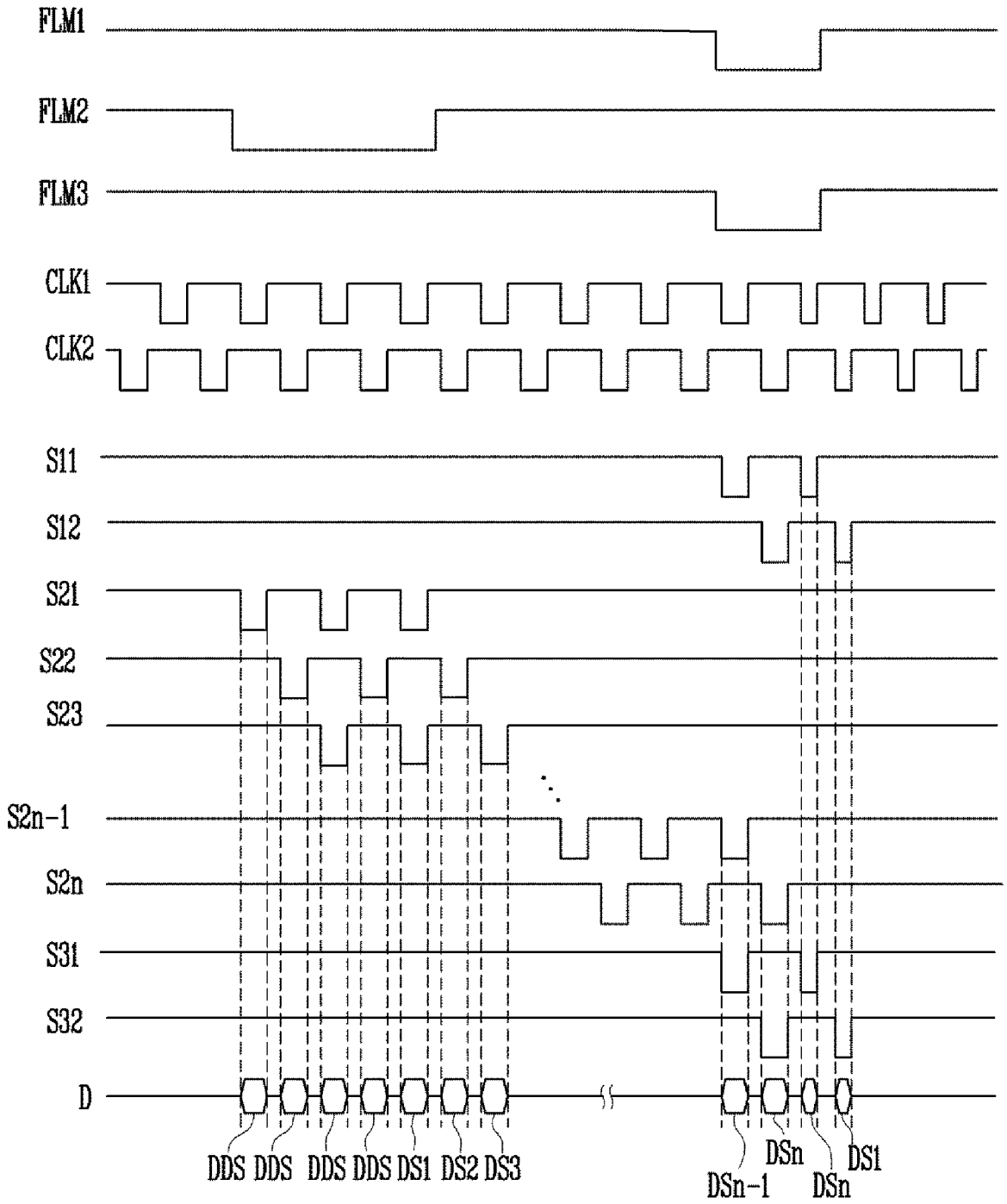

FIG. 12B is a view illustrating still another embodiment of the scan signal supplied to the scan lines when the display device shown in FIG. 2 is driven in the second mode. In FIG. 12B, detailed descriptions of portions identical to those of FIG. 12A will be omitted. Referring to FIG. 12B, when the display device is driven in the second mode, the timing controller 500 simultaneously supplies the first start signal FLM1, the second start signal FLM2, and the third start signal FLM3. Here, the first start signal FLM1 and the third start signal FLM3 are set to have a width narrower than that of the second start signal FLM2.

In addition, at least one of the first and second clock signals CLK1 and CLK2 overlapping with the first start signal FLM1 and the third start signal FLM3 is set to have a width narrower than that of at least one of the first and second clock signals CLK1 and CLK2 overlapping with the second start signal FLM2. Then, at least one first scan signal supplied to the first scan lines S11 and S12, corresponding to the first start signal FLM1 and the third start signal FLM3, and at least one third scan signal supplied to the third scan lines S31 and S32, corresponding to the third start signal FLM3, are set to have a width narrower than that of a second scan signal supplied to the second scan lines S21 to S2*n*.

As described above, if the at least one first scan signal and the at least one third scan signal are set to have a width narrower than that of the second scan signal, a time for supply the second scan signal can be additionally secured. Then, the width of the second scan signal can be widened as compared with FIG. 12A. Accordingly, the stability of driving of the display device can be ensured, and simultaneously, the display quality of the display device can be improved.

Figure 13A:
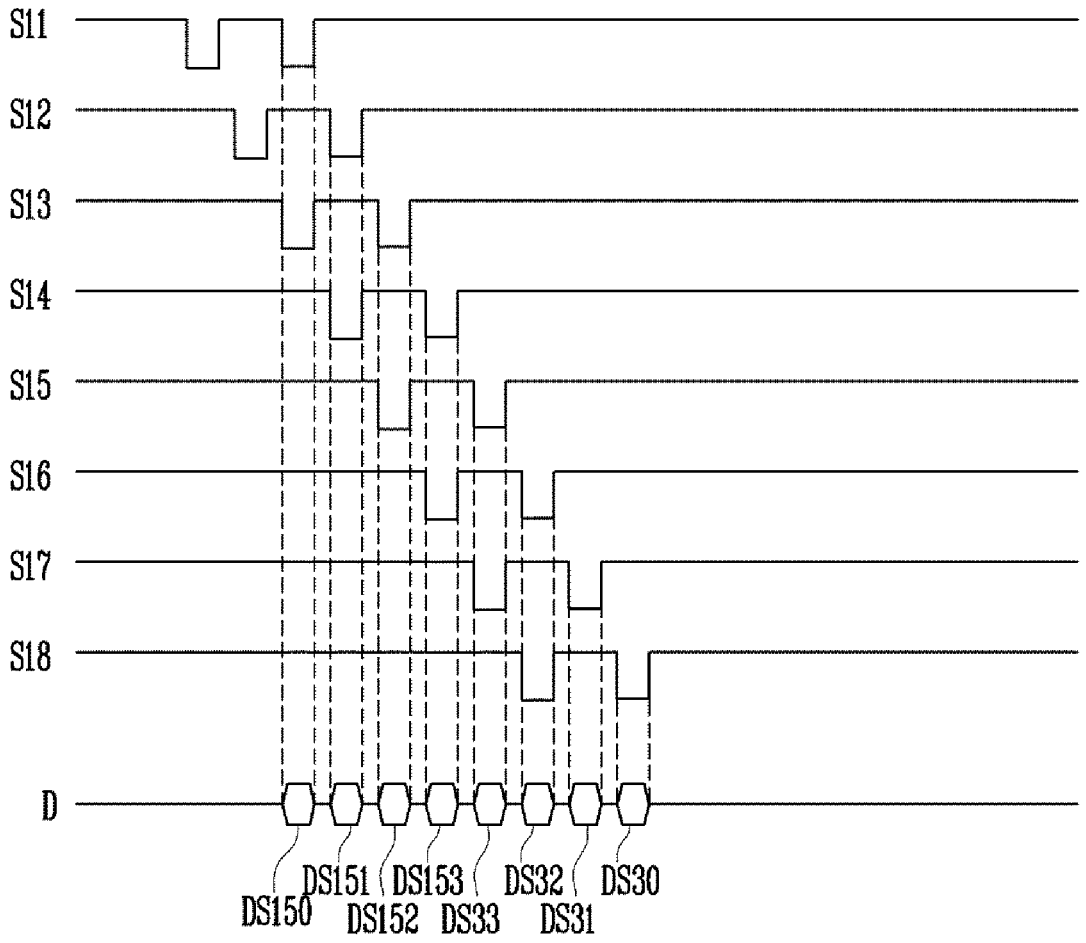
FIGS. 13A to 13C are waveform diagrams illustrating a dummy data signal supplied to a first pixel region and a third pixel region according to some example embodiments of the present invention.
Figure 13B:
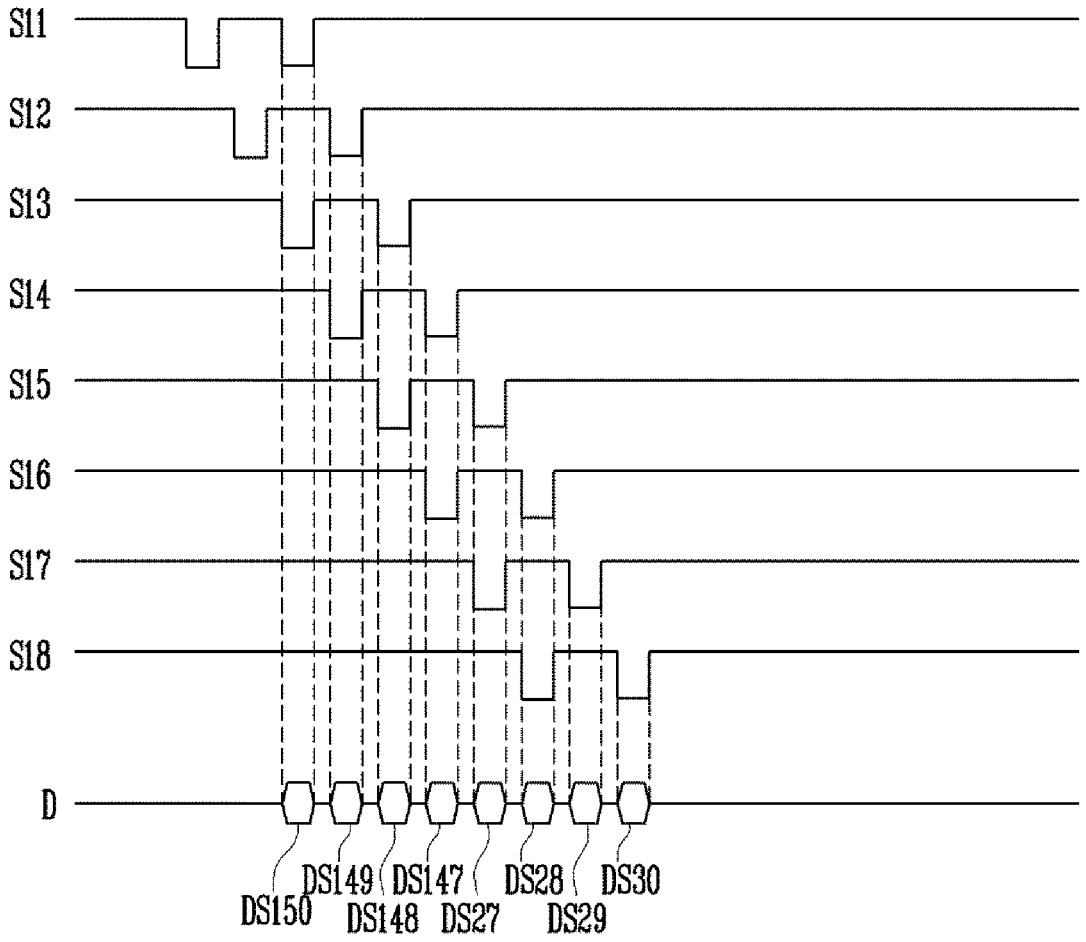
Figure 13C:
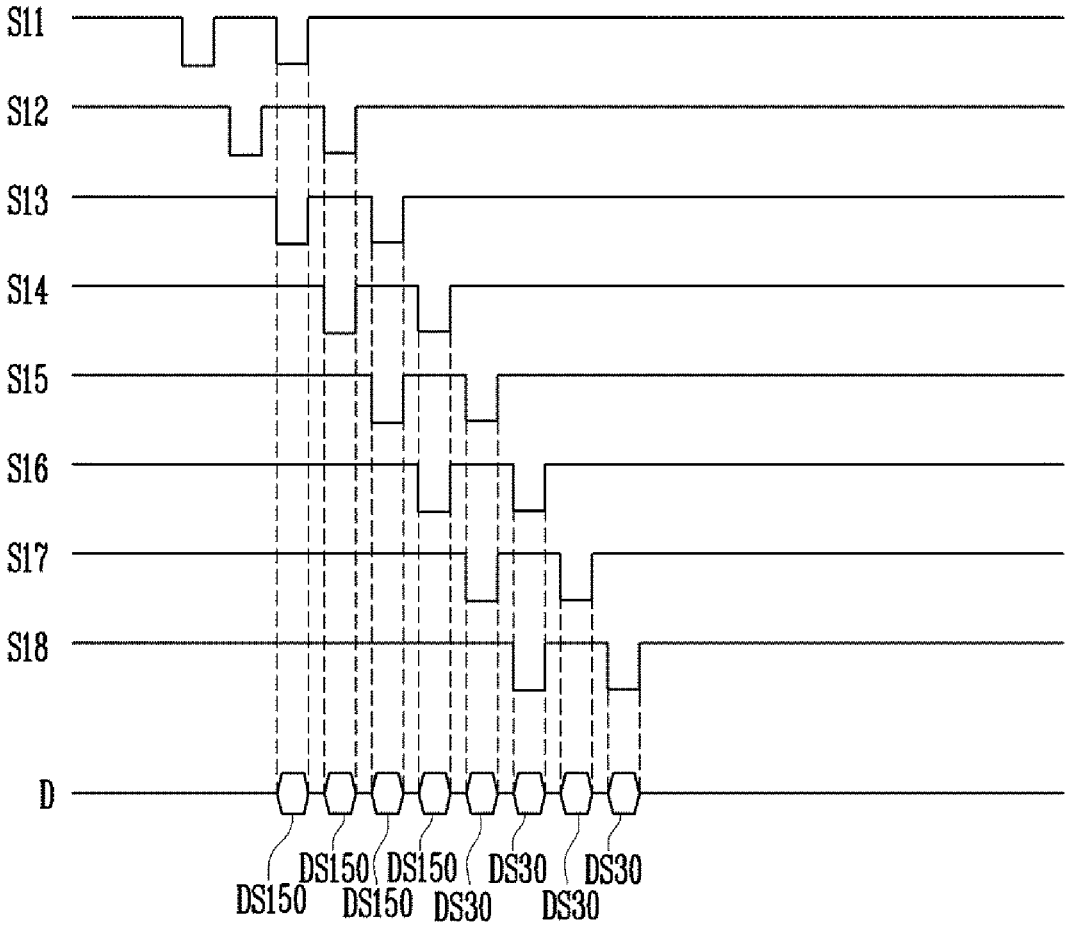

FIGS. 13A to 13C are views illustrating embodiments of a dummy data signal supplied to the first pixel region and the third pixel region. In FIGS. 13A to 13C, the embodiments of the dummy data signal will be described by assuming that 8 first scan lines S11 to S18 are formed in the first pixel region 602. In this case, 8 third scan lines S3 are formed in the third pixel region 606, and the same data signal as the first pixel region 602 may be supplied.

Referring to FIGS. 13A to 13C, when a scan signal is supplied to a first first scan line S11 as described above, a data signal DS150 corresponding to the last horizontal line of the second pixel region 604 is supplied. Here, it is assumed that the data signal DS150 corresponding to the last horizontal line of the second pixel region 604 has a gray level of 150. After that, when the scan signal is supplied to first scan lines S12, S13, and S14 adjacent to the first first scan line S11, data signals DS151, DS152, and DS153 respectively corresponding to a gray level of 151, a gray level of 152, and a gray level of 153 may be supplied. Then, gray levels of horizontal lines adjacent to the first horizontal line of the first pixel region 602 are gradually changed. Here, when the scan signal is supplied to the first scan lines S12, S13, and S14 adjacent to the first first scan line S11, data signals DS149, DS148, and DS147 respectively corresponding to a gray level of 149, a gray level of 148, and a gray level of 147 may be supplied as shown in FIG. 13B.

In addition, when the scan signal is supplied to the last first scan line S18 as described above, a data signal DS30 corresponding to the first horizontal line of the second pixel region 604 is supplied. Here, it is assumed that the data signal DS30 corresponding to the first horizontal line of the second pixel region 604 has a gray level of 30. Then, gray levels of horizontal lines adjacent to the last first scan line S18 are gradually changed from the gray level of 30. For example, data signals DS31, DS32, and DS33 respectively corresponding to a gray level of 31, a gray level of 32, and a gray level of 33 may be supplied to the horizontal lines adjacent to the last first scan line S18, or data signals DS29, DS28, and DS27 respectively corresponding to a gray level of 29, a gray level of 28, and a gray level of 27 may be supplied to the horizontal lines adjacent to the last first scan line S18.

Additionally, as shown in FIG. 13C, when the scan signal is supplied to the first scan lines S12, S13, and S14 adjacent to the first first scan line S11, the same data signal DS150 as the first horizontal line of the second pixel region 604 may be supplied. Similarly, when the scan signal is supplied to first scan lines S15, S16, and S17 adjacent to the last first scan line S18, the same data signal DS30 as the last horizontal line of the second pixel region 604 may be supplied.

Meanwhile, in the above, it has been assumed that the same number of scan lines S1 or S3 are included in each of the first pixel region 602 and the third pixel region 606, but the present disclosure is not limited thereto. For example, scan lines S1 and S3 having numbers different from each other may be included in the first pixel region 602 and the third pixel region 606. Although scan lines S1 and S3 having numbers different from each other may be included in the first pixel region 602 and the third pixel region 606, a dummy data signal is supplied to pixels located on the horizontal lines except the first horizontal line and the last horizontal line. Here, the dummy data signal may be set to have various gray levels.

Figure 14:
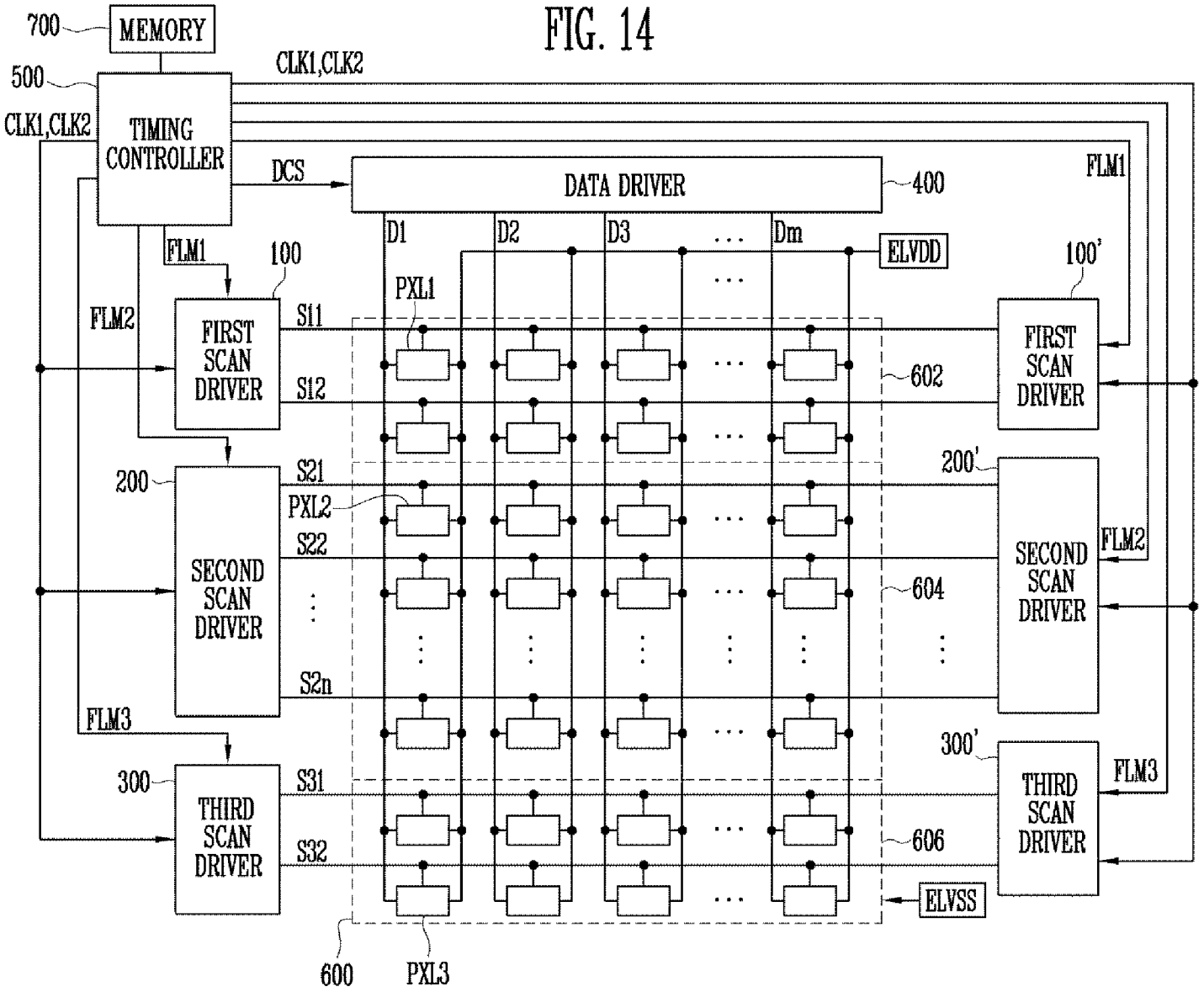
FIG. 14 is a schematic diagram of a display device according to some example embodiments of the present invention.

FIG. 14 is a view illustrating a display device according to another embodiment of the present disclosure. In FIG. 14, components identical to those of FIG. 2 are designated by like reference numerals, and their detailed descriptions will be omitted. Referring to FIG. 14, the display device according to the another embodiment of the present disclosure includes first scan drivers 100 and 100', second scan drivers 200 and 200', third scan drivers 300 and 300', a data driver 400, a timing controller 500, a pixel unit 600, and a memory 700.

In the display device according to the another embodiment of the present disclosure, the first scan drivers 100 and 100', the second scan drivers 200 and 200', the third scan drivers 300 and 300' are located at both sides of the pixel unit 600 with the pixel unit 600 interposed therebetween. At this time, an operation process of each of the first scan drivers 100 and 100', the second scan drivers 200 and 200', the third scan drivers 300 and 300' is the same as described in FIGS. 3A to 13C, and therefore, its detailed description will be omitted.

Figure 15:
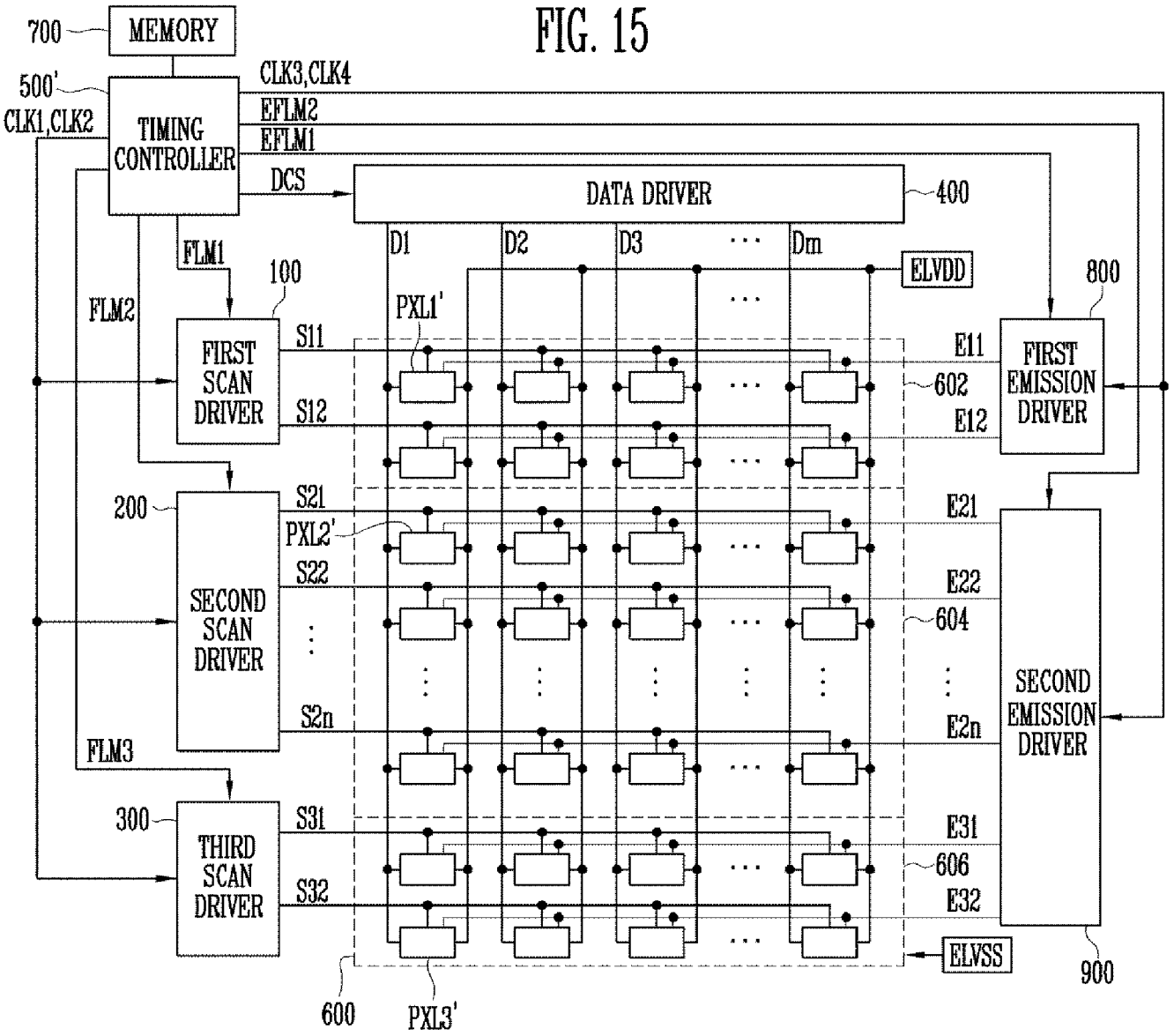
FIG. 15 is schematic diagram of a display device according to some example embodiments of the present invention.

FIG. 15 is a view illustrating a display device according to still another embodiment of the present disclosure. In FIG. 15, components identical to those of FIG. 2 are designated by like reference numerals, and their detailed descriptions will be omitted. Referring to FIG. 15, the display device according to the still another embodiment of the present disclosure includes a first scan driver 100, a second scan driver 200, a third scan driver 300, a data driver 400, a timing controller 500', a pixel unit 600, a memory 700, a first emission driver 800, and a second emission driver 900.

The pixel unit 600 is divided into a first pixel region 602, a second pixel region 604, and a third pixel region 606. The first pixel region 602, the second pixel region 604, and the third pixel region 606 include pixels PXL1', PXL2', and PXL3', respectively, and accordingly can display an image (e.g., a predetermined image).

When the display device is driven in the first mode, as shown in FIG. 3A, an image (e.g., a predetermined image) is displayed in the first pixel region 602, the second pixel region 604, and the third pixel region 606. At this time, a user views the image displayed in the first pixel region 602, the second pixel region 604, and the third pixel region 606.

When the display device is driven in the second mode, as shown in FIG. 3B, an image (e.g., a predetermined image) is displayed in the first pixel region 602, the second pixel region 604, and the third pixel region 606. At this time, only a portion of the image, which is displayed in the second pixel region 604, is viewed by the user.

When the display device is driven in the second mode, portions of the image, which are displayed in the first pixel region 602 and the third pixel region 606, are not viewed by the user. For example, the portions of the image, which are displayed in the first pixel region 602 and the third pixel region 606, are blocked by the frame 30 as shown in FIG. 3C.

Therefore, when the display device is driven in the second mode, the first pixel region 602 and the third pixel region 606 display images (e.g., predetermined images) corresponding to dummy data. At this time, the same image is displayed in the first pixel region 602 and the third pixel region 606. That is, when the display device is driven in the second mode, the first pixel region 602 and the third pixel region 606 display the same image corresponding to the same data signal.

Here, a data signal supplied to the last horizontal line of the first pixel region 602 is set identical to that supplied to the first horizontal line of the second pixel region 604 such that the viewing of a boundary portion between the first pixel region 602 and the second pixel region 604 is minimized. In addition, a data signal supplied to a first horizontal line of the third pixel region 606 is set identical to that supplied to the last horizontal line of the second pixel region 604 such that the viewing of a boundary portion between the second pixel region 604 and the third pixel region 606 is minimized.

First pixels PXL1' are formed in the first pixel region 602. The first pixels PXL1' are located to be coupled to first scan lines S11 and S12, first emission control lines E11 and E12, and data lines D1 to Dm. The first pixels PXL1' are selected when a first scan signal is supplied to the first scan lines S11 and S12 to receive a data signal supplied from the data lines D1 to Dm. In addition, the emission time of the first pixels PXL1' is controlled corresponding to a first emission control signal supplied from the first emission control lines E11 and E12.

Second pixels PXL2' are formed in the second pixel region 604. The second pixels PXL2' are located to be coupled to second scan lines S21 to S2*n*, second emission control lines E21 to E2*n*, and the data lines D1 to Dm. The second pixels PXL2' are selected when a second scan signal is supplied to the second scan lines S21 to S2*n* to receive a data signal supplied from the data lines D1 to Dm. In addition, the emission time of the second pixels PXL2' is controlled corresponding to a second emission control signal supplied from the second emission control lines E21 to E2*n*.

Third pixels PXL3' are formed in the third pixel region 606. The third pixels PXL3' are located to be coupled to third scan lines S31 and S32, third emission control lines E31 and E32, and the data lines D1 to Dm. The third pixels PXL3' are selected when a third scan signal is supplied to the third scan lines S31 and S32 to receive a data signal from the data lines D1 to Dm. In addition, the emission time of the third pixels PXL3' is controlled corresponding to a third emission control signal supplied from the third emission control lines E31 and E32.

Meanwhile, in the embodiment of the present disclosure, each of the first to third pixels PXL1' to PXL3' may be implemented with various types of circuits currently known in the art. For example, each of the first to third pixels PXL1' to PXL3' may be formed in various circuit structures such that its emission time is controlled corresponding to an emission control signal.

Additionally, two first scan lines S11 and S12 and two third scan lines S31 and S32 are illustrated in FIG. 15, but the present disclosure is not limited thereto. The number of first scan lines S1 may be set to be two or more by considering a region overlapping with the frame 30. For example, one hundred or more first scan lines S1 may be formed in the first pixel region 602. Similarly, the number of third scan lines S3 may be set to be two or more by considering a region overlapping with the frame 30. For example, one hundred or more third scan lines S3 may be formed in the third pixel region 606.

The first emission driver 800 supplies the first emission control signal to the first emission control lines E11 and E12. For example, the first emission driver 800 may sequentially supply the first emission control signal to the first emission control lines E11 and E12. The first emission control signal is used to control the emission time of the first pixels PXL1'. To this end, the first emission control signal is set to the gate-off voltage such that transistors included in the first pixels PXL1' can turned off.

The second emission driver 900 supplies the second emission control signal to the second emission control lines E21 to E2*n*, and supplies the third emission control signal to the third emission control lines E31 and E32. For example, the second emission driver 900 may sequentially supply the second emission control signal to the second emission control lines E21 to E2*n*. The second emission driver 900 may sequentially supply the third emission control signal to the third emission control lines E31 and E32 after the second emission control signal is supplied. The second emission control signal is used to control the emission time of the second pixels PXL2', and the third emission control signal is used to control the emission time of the third pixels PXL3'. To this end, the second emission control signal and the third emission control signal are set to the gate-off voltage such that transistors included in the second pixels PXL2' and the third pixels PXL3' can be turned off.

The timing controller 500' generates a first emission start signal EFLM1, a second emission start signal EFLM2, and clock signals CLK3 and CLK4, based on timing signals supplied from the outside. The clock signals CLK3 and CLK4 generated by the timing controller 500' are supplied to the first emission driver 800 and the second emission driver 900. The first emission start signal EFLM1 generated by the timing controller 500' is supplied to the first emission driver 800, and the second emission start signal EFLM2 generated by the timing controller 500' is supplied to the second emission driver 900.

The first emission start signal EFLM1 controls the supply timing of first emission control signals. The clock signals CLK3 and CLK4 are used to shift the first emission start signal EFLM1. The second emission start signal EFLM2 controls the supply timing of second emission control signals. The clock signals CLK3 and CLK4 are used to shift the second emission start signal EFLM2.

Figure 16:
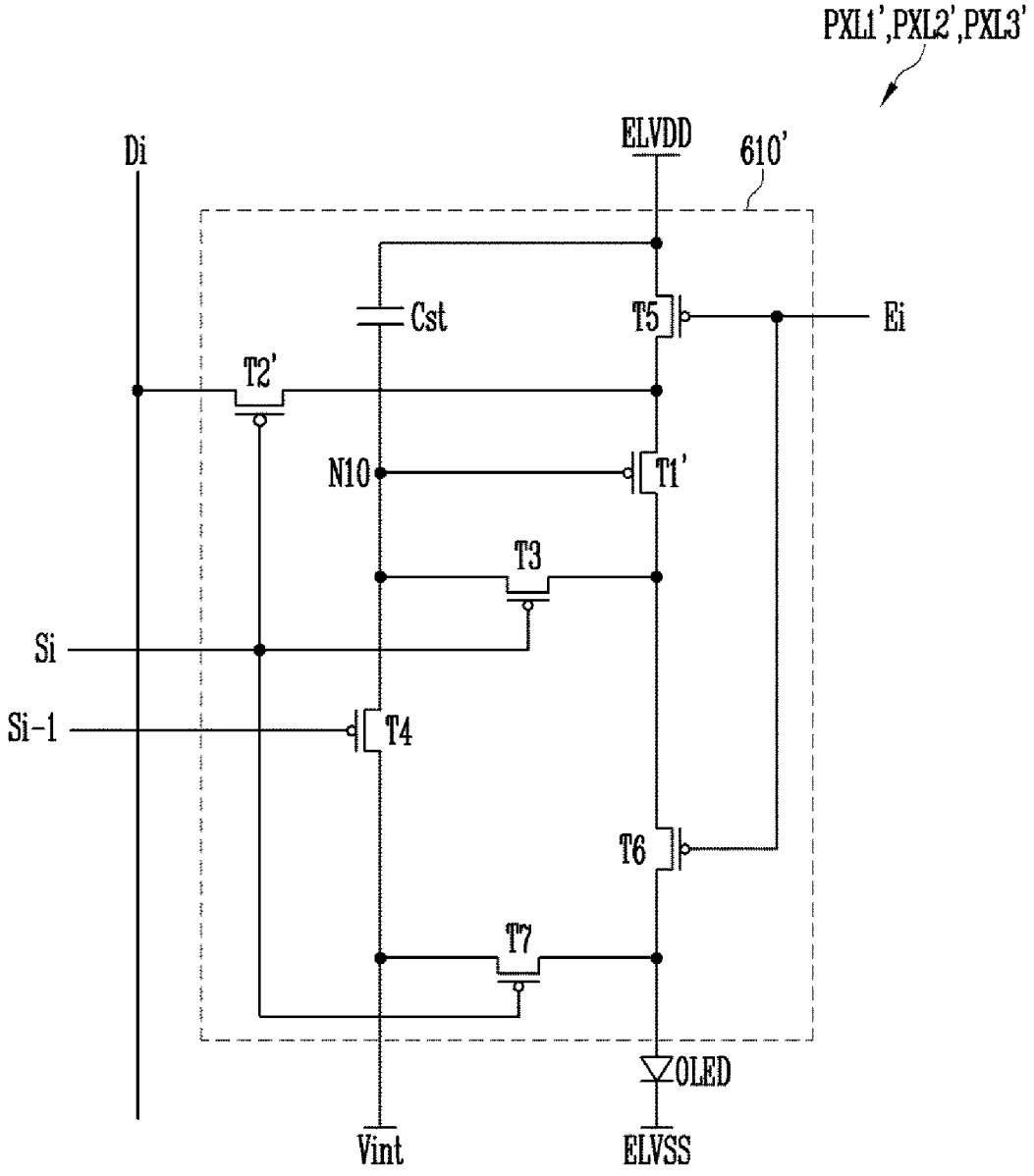
FIG. 16 is a schematic diagram of the pixel shown in FIG. 15 according to some example embodiments of the present invention.

FIG. 16 is a view illustrating an embodiment of the pixel shown in FIG. 15. For convenience of description, a pixel PXL1', PXL2', or PXL3' coupled to an ith data line Di and an ith scan line Si(any one of the first scan lines S11 and S12, the second scan lines S21 to S2*n*, and the third scan lines S31 and S32) is illustrated in FIG. 16. Referring to FIG. 16, the pixel PXL1', PXL2', or PXL3' according to the embodiment of the present disclosure includes an organic light emitting diode OLED and a pixel circuit 610' for controlling the amount of current supplied to the organic light emitting diode OLED.

An anode electrode of the organic light emitting diode OLED is coupled to the pixel circuit 610', and a cathode electrode of the organic light emitting diode OLED is coupled to the second power source ELVSS. The organic light emitting diode OLED generates light of a predetermined luminance corresponding to the amount of current supplied from the pixel circuit 610'.

The pixel circuit 610' controls the amount of current flowing from the first power source ELVDD to the second power source ELVSS via the organic light emitting diode OLED, corresponding to a data signal. To this end, the pixel circuit 610' includes a first transistor T1', a second transistor T2', a third transistor T3, a fourth transistor T4, a fifth transistor T5, a sixth transistor T6, a seventh transistor T7, and a storage capacitor Cst.

The seventh transistor T7 is coupled between an initialization power source Vint and the anode electrode of the organic light emitting diode OLED. In addition, a gate electrode of the seventh transistor T7 is coupled to the ith scan line Si. The seventh transistor T7 is turned on when a scan signal is supplied to the ith scan line Si to supply a voltage of the initialization power source Vint to the anode electrode of the organic light emitting diode OLED. Here, the initialization power source Vint may be set to a voltage lower than that of the data signal.

The sixth transistor T6 is coupled between the first transistor T1' and the organic light emitting diode OLED. In addition, a gate electrode of the sixth transistor T6 is coupled to an emission control line Ei. The sixth transistor T6 is turned off when an emission control signal is supplied to the emission control line Ei, and is turned on otherwise.

The fifth transistor T5 is coupled between the first power source ELVDD and the first transistor T1'. In addition, a gate electrode of the fifth transistor T5 is coupled to the emission control line Ei. The fifth transistor T5 is turned off when the emission control signal is supplied to the emission control line Ei, and is turned on otherwise.

A first electrode of the first transistor (driving transistor) T1' is coupled to the first power source ELVDD via the fifth transistor T5, and a second electrode of the first transistor T1' is coupled to the anode electrode of the organic light emitting diode OLED via the sixth transistor T6. In addition, a gate electrode of the first transistor T1' is coupled to a tenth node N10. The first transistor T1' controls the amount of current flowing from the first power source ELVDD to the second power source ELVSS via the organic light emitting diode OLED, corresponding to a voltage of the tenth node N10.

The third transistor T3 is coupled between the second electrode of the first transistor T1' and the tenth node N10. In addition, a gate electrode of the third transistor T3 is coupled to the ith scan line Si. The third transistor T3 is turned on when the scan signal is supplied to the ith scan line Si to allow the second electrode of the first transistor T1' and the tenth node N10 to be electrically coupled to each other. Therefore, when the third transistor T3 is turned on, the first transistor T1' is diode-coupled.

The fourth transistor T4 is coupled between the tenth node N10 and the initialization power source Vint. In addition, a gate electrode of the fourth transistor T4 is coupled to an (i−1)th scan line Si-1. The fourth transistor T4 is turned on when a scan signal is supplied to the (i−1)th scan line Si-1 to supply the voltage of the initialization power source Vint to the tenth node N10.

The second transistor T2' is coupled between the data line Di and the first electrode of the first transistor T1'. In addition, a gate electrode of the second transistor T2' is coupled to the ith scan line Si. The second transistor T2' is turned on when the scan signal is supplied to the ith scan line Si to allow the data line Di and the first electrode of the first transistor T1' to be electrically coupled to each other.

The storage capacitor Cst is coupled between the first power source ELVDD and the tenth node N10. The storage capacitor Cst stores a voltage corresponding to the data signal and a threshold voltage of the first transistor T1'.

Figure 17:
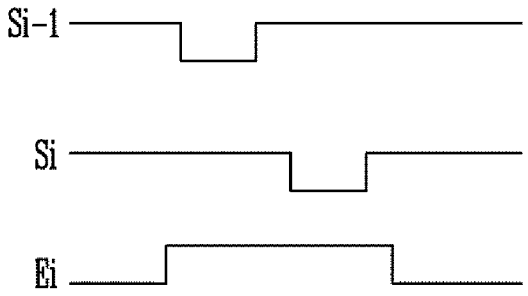
FIG. 17 is a waveform diagram illustrating a driving method of the pixel shown in FIG. 16 according to some example embodiments of the present invention.

FIG. 17 is a view illustrating an embodiment of a driving method of the pixel shown in FIG. 15. Referring to FIG. 17, an emission control signal is first supplied to the emission control line Ei. If the emission control signal is supplied to the emission control line Ei, the fifth transistor T5 and the sixth transistor T6 are turned off. At this time, the pixel PXL1', PXL2', or PXL3' is set to a non-emission state.

After that, a scan signal is supplied to the (i−1)th scan line Si-1 such that the fourth transistor T4 is turned on. If the fourth transistor T4 is turned on, a voltage of the initialization power source Vint is supplied to the tenth node N10. Then, the tenth node N10 is initialized to the voltage of the initialization power source Vint.

After the tenth node N10 is initialized to the voltage of the initialized power source Vint, a scan signal is supplied to the ith scan line Si. If the scan signal is supplied to the ith scan line Si, the second transistor T2', the third transistor T3, and the seventh transistor T7 are turned on.

If the seventh transistor T7 is turned on, the voltage of the initialization power source Vint is supplied to the anode electrode of the organic light emitting diode OLED. Then, a parasitic capacitor parasitically formed in the organic light emitting diode OLED is discharged, and accordingly, the black expression ability of the pixel can be enhanced.

For example, the parasitic capacitor of the organic light emitting diode OLED is charged with a voltage (e.g., a predetermined voltage) corresponding to current supplied to a previous frame. When a black gray level is expressed in a current frame, the organic light emitting diode OLED is to maintain the non-emission state. Here, when the parasitic capacitor of the organic light emitting diode OLED maintains a charging state, the organic light emitting diode OLED may minutely emit light due to leakage current of the first transistor T1'.

On the other hand, when the parasitic capacitor of the organic light emitting diode OLED is discharged, the leakage current of the first transistor T1' pre-charges the parasitic capacitor of the organic light emitting diode OLED, and accordingly, the organic light emitting diode OLED maintains the non-emission state. If the third transistor T3 is turned on, the first transistor T1' is diode-coupled.

If the second transistor T2' is turned on, a data signal from the data line Di is supplied to the first electrode of the first transistor T1'. At this time, because the tenth node N10 is initialized to the voltage of the initialization power source Vint, which is lower than the data signal, the first transistor T1' is turned on. If the first transistor T1' is turned on, a voltage obtained by subtracting a threshold voltage of the first transistor T1' from the data signal is applied to the tenth node N10. The storage capacitor Cst stores a voltage corresponding to the data signal and the threshold voltage of the first transistor T1', which is applied to the tenth node N10.

After the voltage corresponding to the data signal and the threshold voltage of the first transistor T1' is stored in the storage capacitor Cst, the supply of the emission control signal to the emission control line Ei is stopped.

If the supply of the emission control signal to the emission control line Ei is stopped, the fifth transistor T5 and the sixth transistor T6 are turned on. Then, there is formed a current path from the first power source ELVDD to the second power source ELVSS via the fifth transistor T5, the first transistor T1', the sixth transistor T6, and the organic light emitting diode OLED. At this time, the first transistor T1' controls the amount of current flowing from the first power source ELVDD to the second power source ELVSS via the organic light emitting diode OLED, corresponding to a voltage of the tenth node N10. The organic light emitting diode OLED generates light of a predetermined luminance corresponding to the amount of the current supplied from the first transistor T1'.

Actually, the pixel PXL1', PXL2', or PXL3' generates light of a predetermined luminance while repeating the above-described process. In the embodiment of the present disclosure, the pixel structure of the pixel PXL1', PXL2', or PXL3' is not limited by FIG. 16. For example, the pixel PXL1', PXL2', or PXL3' may be implemented with various types of circuits currently known in the art.

The emission control signal supplied to the emission control line Ei is supplied to overlap with at least one scan signal such that the pixel PXL1', PXL2', or PXL3' is set to the non-emission state during a period in which the data signal is charged in the pixel PXL1', PXL2', or PXL3'. The supply timing of the emission control signal may be set in various manners currently known in the art.

Figure 18:
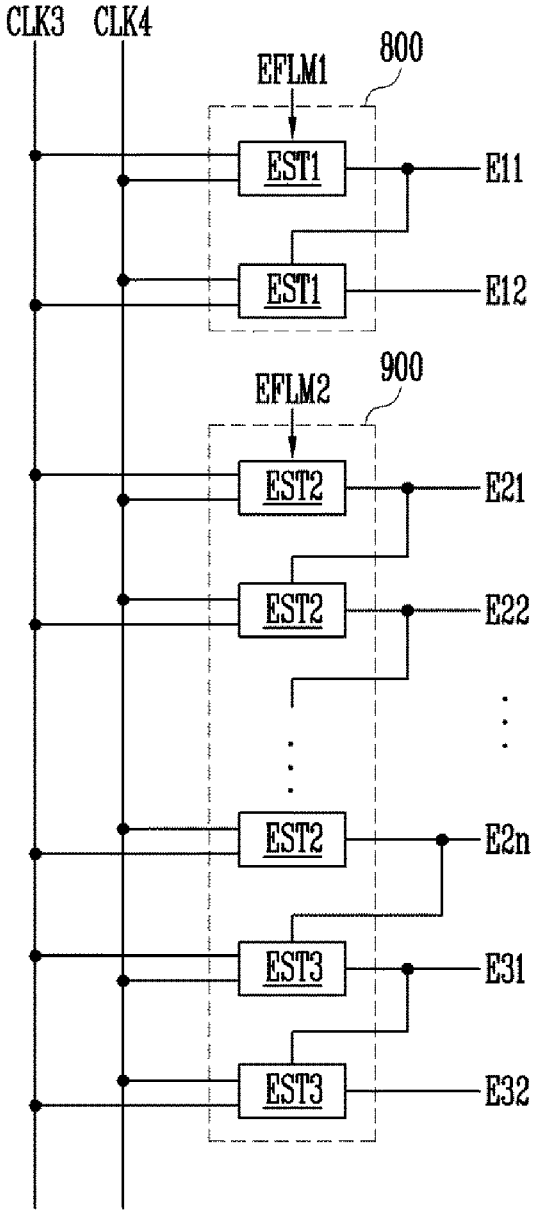
FIG. 18 is a view illustrating an embodiment of emission drivers shown in FIG. 15 according to some example embodiments of the present invention.

FIG. 18 is a view illustrating an embodiment of the emission drivers shown in FIG. 15. Referring to FIG. 18, the first emission driver 800 includes first emission stages EST1 respectively coupled to the first emission control lines E11 and E12. In addition, the second emission driver 900 includes second emission stages EST2 respectively coupled to the second emission control lines E21 to E2*n* and third emission stages EST3 respectively coupled to the third emission control lines E31 and E32.

The first emission stages EST1 are supplied with clock signals CLK3 and CLK4, and supply a first emission control signal to each of the first emission control lines E11 and E12, corresponding to the first emission start signal EFLM1.

A first first emission stage EST1 supplies a first emission control signal to a first first emission control line El 1, corresponding to the first emission start signal EFLM1. A second first emission stage EST1 supplies a first emission control signal to a second first emission line E12, corresponding to an output signal (e.g., a first emission control signal) of the first first emission stage EST1.

Here, a width of the first emission control signal is determined corresponding to that of the first emission start signal EFLM1. That is, as the width of the first emission start signal EFLM1 becomes wider, the width of the first emission control signal is also set wider. The width of the first emission start signal EFLM1 may be determined by a structure of the pixel PXL1', PXL2', or PXL3' and a first scan signal supplied to the first scan lines S11 and S12.

That is, the width of the first emission start signal EFLM1 may be set such that the first emission control signal supplied to the first first emission control line E11 overlaps with at least one first scan signal supplied to a first first scan line S11.

The second emission stages EST2 are supplied with clock signals CLK3 and CLK4. The second emission stages EST2 supply a second emission control signal to each of the second emission control lines E21 to E2*n* and supply a third emission control signal to each of the third emission control lines E31 and E32, corresponding to the second emission start signal EFLM2.

A first second emission stage EST2 supplies a second emission control signal to a first second emission control line E21, corresponding to the second emission start signal EFLM2. Each of the other second emission stages EST2 supplies a second emission control signal to a second emission control line (any one of E22 to E2*n*) coupled thereto, corresponding to an output signal (i.e., a second emission control signal) of a previous stage.

A first third emission stage EST3 supplies a third emission control signal to a first third emission control line E31, corresponding to an output signal of the last second emission stage EST2. A second third emission stage EST3 supplies a third emission control signal to a second third emission control line E32, corresponding to an output signal of the first third emission stage EST3. In this case, the second emission control signal and the third emission control signal are sequentially supplied to the second emission control lines E22 to E2*n* and the third emission control lines E31 and E32, respectively.

Widths of the second emission control signal and the third emission control signal are determined corresponding to a width of the second emission start signal EFLM2. That is, as the width of the second emission start signal EFLM2 becomes wider, the widths of the second emission control signal and the third emission control signal are also set wider. Here, the width of the second emission start signal EFLM2 may be set such that the second emission control signal supplied to the first second emission control line E21 overlaps with at least one second scan signal supplied to the first second scan line S21.

Meanwhile, in the embodiment of the present disclosure, the emission stages EST1, EST2, or EST3 may control the width of an emission control signal to the emission control line, corresponding to the width of the emission start signal EFLM1 or EFLM2. The emission stages EST1, EST2, or EST3 may be implemented with various types of circuits currently known in the art.

Figure 19A:
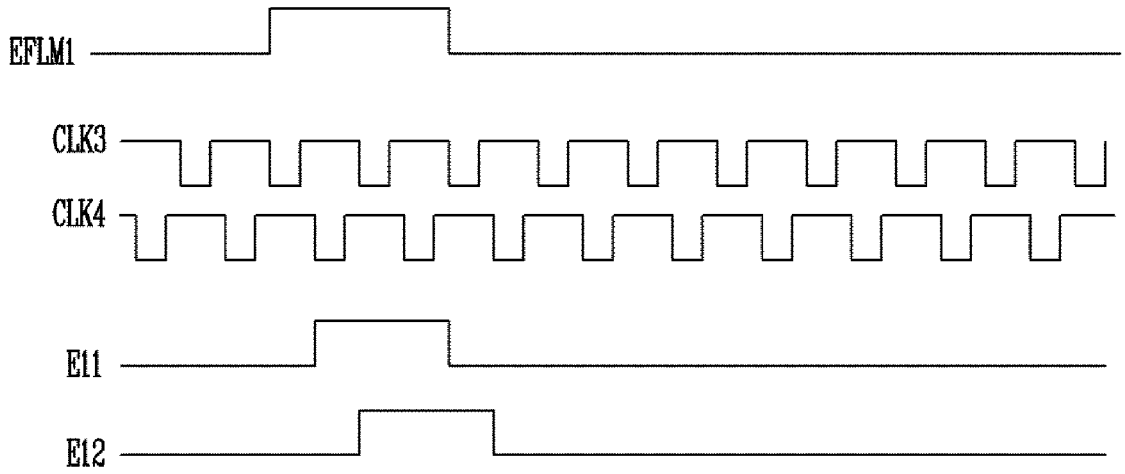
FIGS. 19A and 19B are waveform diagrams illustrating an operation process of first emission stages shown in FIG. 18 according to some example embodiments of the present invention.
Figure 19B:
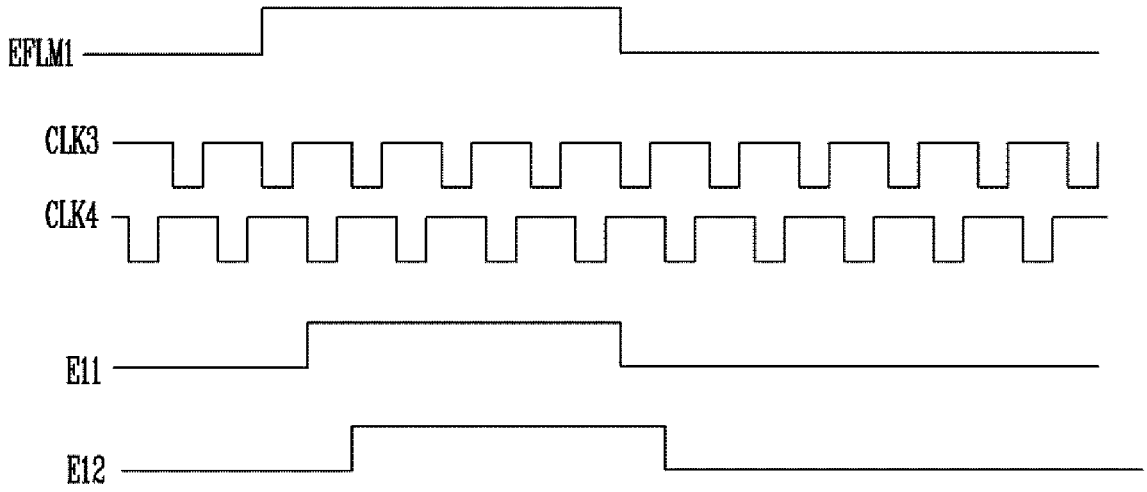

FIGS. 19A and 19B are views schematically illustrating an operation process of the first emission stages shown in FIG. 18. Referring to FIGS. 19A and 19B, the first emission start signal EFLM1 is supplied to the first first emission stage EST1. At this time, the first first emission stage ESTI outputs a first emission control signal from a point of time when the first emission start signal EFLM1 overlaps with a fourth clock signal CLK4. In addition, the first first emission stage ESTI stops the output of the first emission control signal at a point of time when the first emission start signal EFLM1 does not overlap with a third clock signal CLK3. In this case, as shown in FIGS. 19A and 19B, the width of the first emission control signal is controlled corresponding to the width of the first emission start signal EFLM1.

The second first emission stage EST1 received the first emission control signal input from the first first emission stage EST1. At this time, the second first emission stage EST1 outputs a first emission control signal from a point of time when the first emission control signal input thereto overlaps with the third clock signal CLK3. In addition, the second first emission stage ESTI stops the output of the first emission control signal at a point of time when the first emission control signal does not overlap with the fourth clock signal CLK4. In this case, as shown in FIGS. 19A and 19B, the width of the first emission control signal is controlled corresponding to the width of the first emission start signal EFLM1.

Meanwhile, the second emission stage EST2 and the third emission stage EST3 are driven in the same manner as the first emission stage EST1, and therefore, repetitive descriptions will be omitted.

Figure 20:
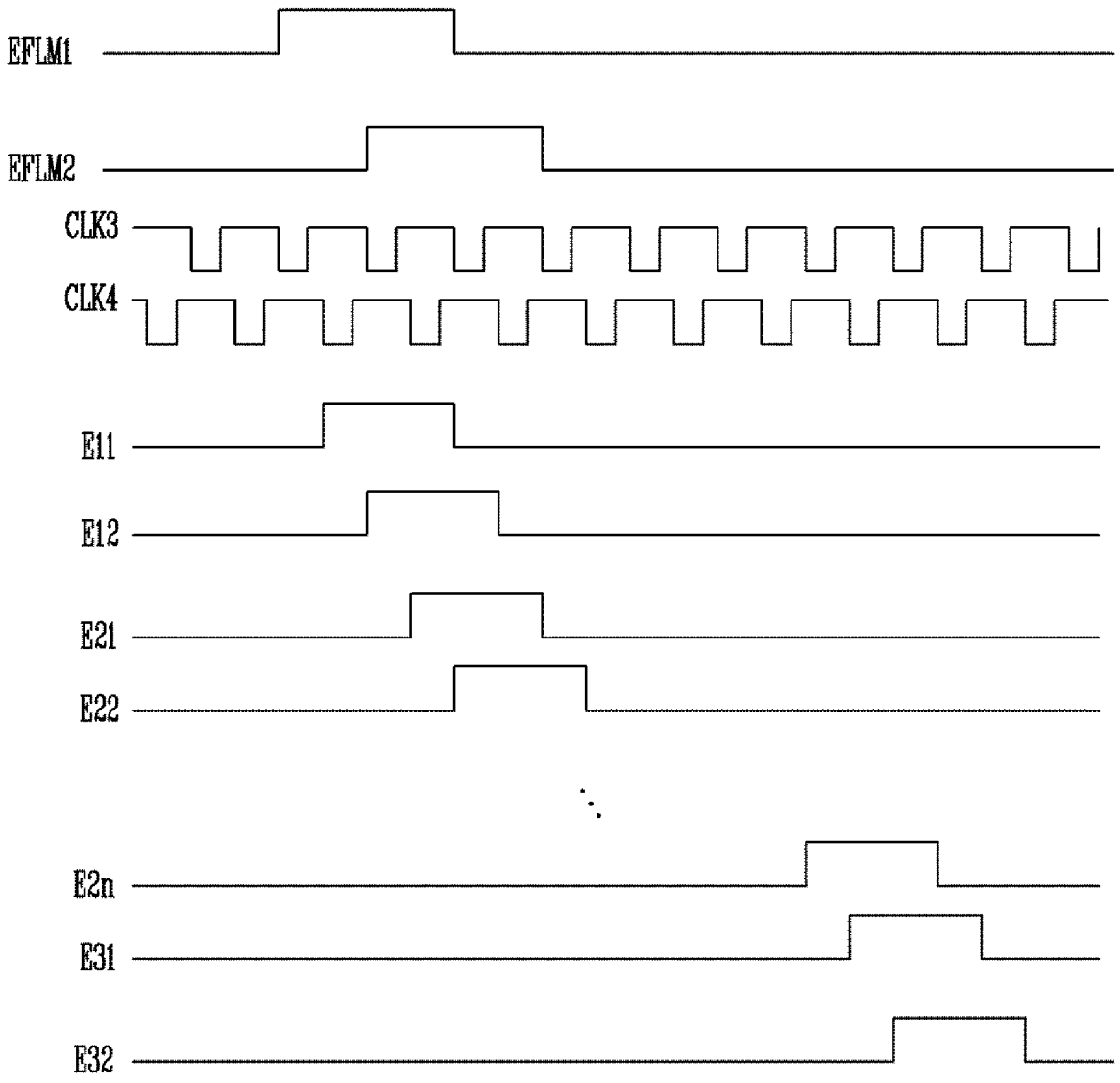
FIG. 20 is a waveform diagram illustrating an embodiment of an emission control signal supplied to emission control lines when the display device shown in FIG. 15 is driven in the first mode according to some example embodiments of the present invention.

FIG. 20 is a view illustrating an embodiment of an emission control signal supplied to the emission control lines when the display device shown in FIG. 15 is driven in the first mode. Here, the same scan signals as FIG. 7 or 11 are supplied to the scan lines S1, S2, and S3. Referring to FIG. 20, when the display device is driven in the first mode, the timing controller 500' sequentially supplies the first emission start signal EFLM1 and the second emission start signal EFLM2. Here, the supply timing of the first emission start signal EFLM1 and the second emission start signal EFLM2 is set such that a first emission control signal and a second emission control signal are sequentially supplied to the first emission control lines E11 and E12 and the second emission control lines E21 to E2*n*, respectively. At this time, the first emission start signal EFLM1 and the second emission start signal EFLM2 are set to have the same width.

If the first emission start signal EFLM1 is supplied, the first emission control signal is sequentially supplied to the first emission control lines E11 and E12. At this time, the first emission control signal supplied to an ith first emission control line E1*i* overlaps with scan signals supplied to an ith first scan line S1*i*.

If the second emission start signal EFLM2 is supplied, the second emission control signal is sequentially supplied to the second emission control lines E21 to E2*n*. At this time, the second emission control signal supplied to an ith second emission control line E2*i* overlaps with scan signals supplied to an ith second scan line S2*i*.

A third emission control signal is sequentially supplied to the third emission control lines E31 and E32, corresponding to the second emission control signal supplied to the last second emission control line E2*n*. At this time, the third emission control signal supplied to an ith third emission control line E3*i* overlaps with scan signals supplied to an ith third scan line S3*i*.

When the display device is driven in the first mode, the emission drivers 800 and 900 sequentially supply an emission control signal to the emission control lines E1, E2, and E3 while repeating the above-described process.

Figure 21:
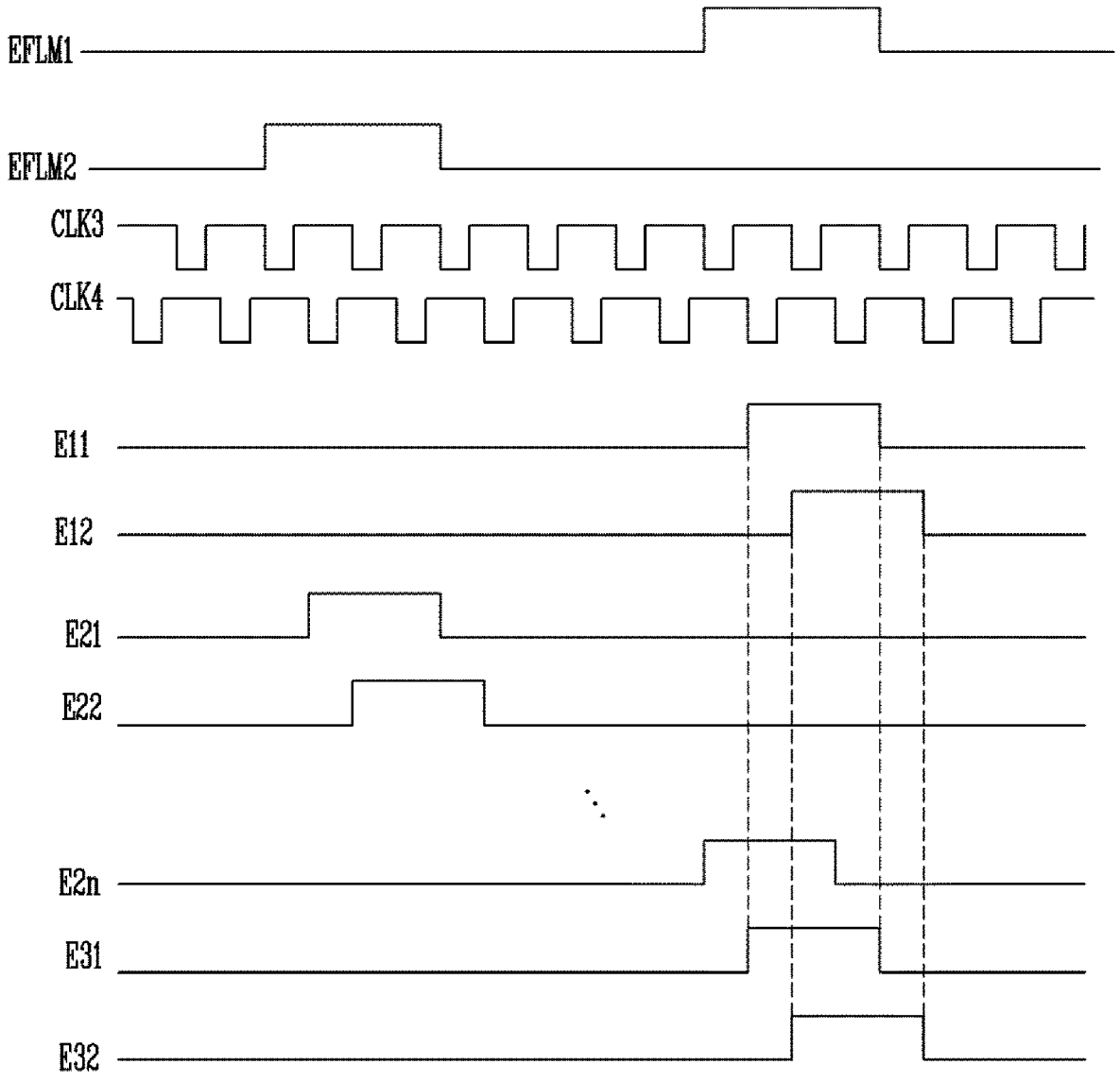
FIG. 21 is a waveform diagram illustrating an embodiment of an emission control signal supplied to the emission control lines when the display device shown in FIG. 15 is driven in the second mode according to some example embodiments of the present invention.

FIG. 21 is a view illustrating an embodiment of an emission control signal supplied to the emission control lines when the display device shown in FIG. 15 is driven in the second mode. Here, the same scan signals as FIGS. 8 and 12 are supplied to the scan lines S1, S2, and S3.

Referring to FIG. 21, when the display device is driven in the second mode, the timing controller 500' supplies the second emission start signal EFLM2 and then supplies the first emission start signal EFLM1. Here, the first emission start signal EFLM1 and the second emission start signal EFLM2 are set to have the same width.

If the second emission start signal EFLM2 is supplied, a second emission control signal is sequentially supplied to the second emission control lines E21 to E2*n*. At this time, the second emission control signal supplied to an ith second emission control line E2*i* overlaps with scan signals supplied to an ith second scan line S2*i*.

The supply timing of the first emission start signal EFLM1 is set such that a first emission control signal is supplied to the first first emission control line E11 at the same time when a third emission control signal is supplied to the first third emission control line E31.

If the first emission start signal EFLM1 is supplied, a first emission control signal is sequentially supplied to the first emission control lines E11 and E12. At this time, the first emission control signal supplied to an ith first emission control line E1*i* overlaps with first scan signals supplied to an ith first scan line S1*i*.

When the first emission control signal is supplied to the first first emission control line E11, the third emission control signal is supplied to the first third emission control line E31. After that, the third emission control signal is sequentially supplied to the other third emission control line E32. At this time, the third emission control signal supplied to an ith third emission control line E3*i* overlaps with third scan signals supplied to an ith third scan line S3*i*.

When the display device is driven in the second mode, the emission drivers 800 and 900 sequentially supply a first emission control signal and a third emission control signal at the same time, corresponding to a first scan signal and a third scan signal, which are sequentially supplied at the same time.

Figure 22:
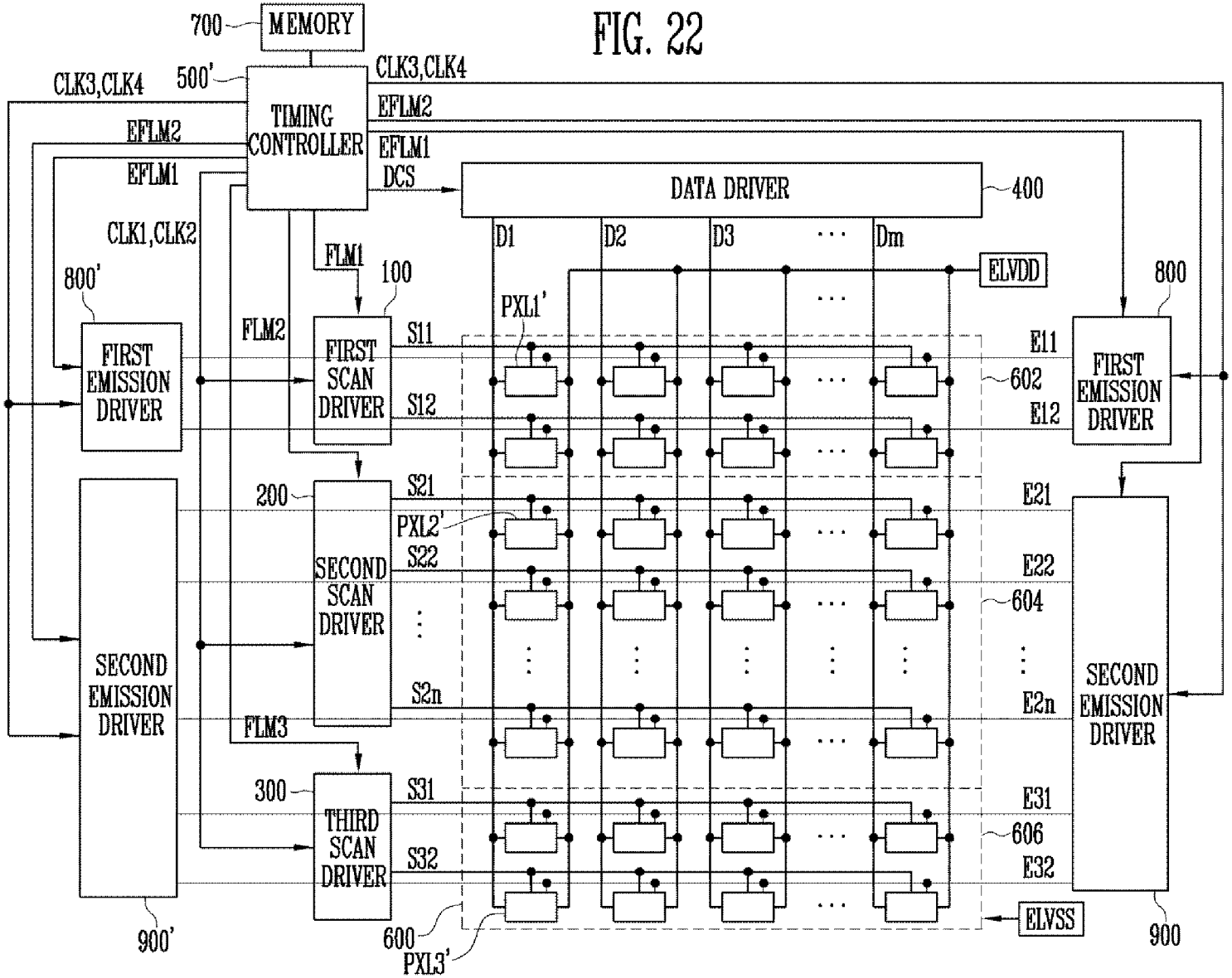
FIG. 22 is a schematic diagram illustrating a display device according to some example embodiments of the present invention.

FIG. 22 is a view illustrating a display device according to still another embodiment of the present disclosure. In FIG. 22, components identical to those of FIG. 15 are designated by like reference numerals, and their detailed descriptions will be omitted.

Referring to FIG. 22, the display device according to the still another embodiment of the present disclosure includes a first scan driver 100, a second scan driver 200, a third scan driver 300, a data driver 400, a timing controller 500', a pixel unit 600, a memory 700, first emission drivers 800 and 800', and second emission drivers 900 and 900'.

In the display device according to the still another embodiment of the present disclosure, the first emission drivers 800 and 800' and the second emission drivers 900 and 900' are located at both sides of the pixel unit 600 with the pixel unit 600 interposed therebetween. At this time, an operation process of each of the first emission drivers 800 and 800' and the second emission drivers 900 and 900' is the same as described above, and therefore, its detailed description will be omitted In the display device and the driving method thereof according to the present disclosure, when the display device is attached to the HMD, an image (e.g., a predetermined image) is displayed in the entire region of the effective display unit. In this case, characteristics of the driving transistors can be prevented from being differently set corresponding to positions of the display device, and accordingly, the display quality of the display device can be improved.

Further, according to some example embodiments of the present invention, when the display device is attached to the HMD, scan signals are simultaneously supplied to a region not viewed by a user, and accordingly, a time necessary for driving can be additionally secured.

Aspects of some example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, and their equivalents.

What is claimed is:

1. A display device comprising:

a pixel unit including first pixels in a first pixel region, second pixels in a second pixel region, and third pixels in a third pixel region;

a first scan driver configured to drive first scan lines coupled to the first pixels;

a second scan driver configured to drive second scan lines coupled to the second pixels; and a third scan driver configured to drive third scan lines coupled to the third pixels, wherein the first scan driver, the second scan driver, and the third scan driver differently set a supply order of a scan signal supplied to the first scan lines, the second scan lines, and the third scan lines, corresponding to a first mode and a second mode different from the first mode, wherein the first scan driver, the second scan driver, and the third scan driver are configured to sequentially supply the scan signal to the first pixel region, the second pixel region, and the third pixel region in the first mode, and the first scan driver, the second scan driver, and the third scan driver are configured such that, in the second mode, the second scan driver supplies the scan signal to the second pixel region and then the first and third scan drivers supply the scan signal to the first pixel region and the third pixel region.

2. The display device of claim 1, wherein the display device is set to the second mode when the display device is mounted in a wearable device, and is set to the first mode otherwise.

3. The display device of claim 1, further comprising a timing controller configured to supply a first start signal to the first scan driver, supply a second start signal to the second scan driver, and supply a third start signal to the third scan driver.

4. The display device of claim 3, wherein, when the display device is driven in the first mode, the first scan driver, the second scan driver, and the third scan driver are configured to sequentially supply the scan signal to the first scan lines, the second scan lines, and the third scan lines.

5. The display device of claim 3, wherein, when the display device is driven in the first mode, the timing controller is configured to sequentially supply the first start signal, the second start signal, and the third start signal.

6. The display device of claim 5, wherein the first start signal, the second start signal, and the third start signal are set to have the same width.

7. The display device of claim 3, wherein, when the display device is driven in the second mode, the second scan driver is configured to sequentially supply a scan signal to the second scan lines, and the first scan driver and the third scan driver are configured to sequentially supply a scan signal to the first scan lines and the third scan lines at the same time.

8. The display device of claim 7, wherein the scan signal supplied to the first scan lines and the third scan lines is set to have a width narrower than that of the scan signal supplied to the second scan lines.

9. The display device of claim 7, wherein, when the display device is driven in the second mode, k (k is a natural number of 3 or more) scan signals are supplied to each of the second scan lines, and I (I is a natural number smaller than k) scan signals are supplied to each of the first scan lines and the third scan lines.

10. The display device of claim 9, wherein at least one scan signal supplied to the first scan lines and the third scan lines is set to have a width narrower than that of the scan signal supplied to the second scan lines.

11. The display device of claim 3, wherein, when the display device is driven in the second mode, the timing controller is configured to supply the second start signal and then to supply the first start signal and the third start signal at the same time.

12. The display device of claim 11, wherein the second start signal is set to have a width wider than that of each of the first start signal and the third start signal.

13. The display device of claim 1, further comprising:

a first emission driver configured to supply an emission control signal to first emission control lines coupled to the first pixels; and a second emission driver configured to supply an emission control signal to second emission control lines coupled to the second pixels and third emission control lines coupled to the third pixels.

14. The display device of claim 13, further comprising a timing controller configured to supply a first emission start signal to the first emission driver and supply a second emission start signal to the second emission driver.

15. The display device of claim 14, wherein, when the display device is driven in the first mode, the first emission driver and the second emission driver are configured to sequentially supply the emission control signal to the first emission control lines, the second emission control lines, and the third emission control lines.

16. The display device of claim 14, wherein, when the display device is driven in the first mode, the timing controller is configured to sequentially supply the first emission start signal and the second emission start signal.

17. The display device of claim 14, wherein, when the display device is driven in the second mode, the second emission driver is configured to sequentially supply an emission control signal to the second emission control lines and the third emission control lines, and the first emission driver is configured to sequentially supply an emission control signal to the first emission control lines to overlap with the emission control signal supplied to the third emission control lines.

18. The display device of claim 14, wherein, when the display device is driven in the second mode, the timing controller is configured to sequentially supply the second emission start signal and the first emission start signal.

19. The display device of claim 1, wherein the first pixel region is located adjacent to a first horizontal line of the second pixel region, and the third pixel region is adjacent to the last horizontal line of the second pixel region.

20. The display device of claim 19, further comprising a data driver configured to supply a data signal to data lines coupled to the first pixels, the second pixels, and the third pixels.

21. The display device of claim 20, wherein, when the display device is driven in the second mode, the data driver is configured to supply data signals of the first horizontal line of the second pixel region to the last horizontal line of the first pixel region, and to supply data signals of the last horizontal line of the second pixel region to a first horizontal line of the third pixel region.

22. The display device of claim 21, further comprising a memory configured to store first data corresponding to the first horizontal line of the second pixel region and second data corresponding to the last horizontal line of the second pixel region.

23. The display device of claim 20, wherein, when the display device is driven in the second mode, the data driver is configured to supply the same data signal to the first pixel region and the third pixel region.

24. A method for driving a display device including a first pixel region, a second pixel region, and a third pixel region, which are adjacent to each other and each includes at least two scan lines, the method comprising:

when the display device is driven in a first mode, sequentially supplying a scan signal to the first pixel region, the second pixel region, and the third pixel region; and when the display device is driven in a second mode different from the first mode, supplying a scan signal to the second pixel region and then supplying a scan signal to the first pixel region and the third pixel region.

25. The method of claim 24, wherein the display device is set to the second mode when the display device is mounted in a wearable device, and is set to the first mode otherwise.

26. The method of claim 24, wherein, when the display device is driven in the second mode, simultaneously supplying a scan signal to the first pixel region and the third pixel region.

27. The method of claim 24, wherein, when the display device is driven in the second mode, supplying data signals of a first horizontal line of the second pixel region to the last horizontal line of the first pixel region, and supplying data signals of the last horizontal line of the second pixel region to a first horizontal line of the third pixel region.

28. The method of claim 24, wherein, when the display device is driven in the second mode, displaying the same image in the first pixel region and the third pixel region.

* * * * *